US010877427B2

(12) United States Patent
Nohara

(10) Patent No.: US 10,877,427 B2
(45) Date of Patent: Dec. 29, 2020

(54) IMAGE FORMING APPARATUS

(71) Applicant: KYOCERA Document Solutions Inc., Osaka (JP)

(72) Inventor: Yuta Nohara, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/885,182

(22) Filed: May 27, 2020

(65) Prior Publication Data

US 2020/0379402 A1 Dec. 3, 2020

(30) Foreign Application Priority Data

May 30, 2019 (JP) ..... 2019-100882

(51) Int. Cl.
*G03G 21/16* (2006.01)
*G03G 15/08* (2006.01)

(52) U.S. Cl.
CPC ..... *G03G 21/1633* (2013.01); *G03G 15/0865* (2013.01); *G03G 21/1619* (2013.01); *G03G 2221/1654* (2013.01); *G03G 2221/1657* (2013.01)

(58) Field of Classification Search
CPC . G03G 15/0865–0875; G03G 21/1633; G03G 2215/066–0685; G03G 2221/1654
See application file for complete search history.

(56) References Cited

U.S. PATENT DOCUMENTS

2011/0058825 A1* 3/2011 Tsukijima ..... G03G 21/1633 399/27
2016/0103416 A1* 4/2016 Eto ..... G03G 21/1633 399/119
2017/0139365 A1* 5/2017 Ootsuka ..... G03G 15/0867
2017/0315499 A1 11/2017 Maeda
2018/0179796 A1* 6/2018 Ando ..... E05C 19/06

FOREIGN PATENT DOCUMENTS

JP 2017-198857 11/2017

* cited by examiner

*Primary Examiner* — Thomas S Giampaolo, II
(74) *Attorney, Agent, or Firm* — Gerald E. Hespos; Michael J. Porco; Matthew T. Hespos

(57) ABSTRACT

An image forming apparatus includes an apparatus body, an image carrier, a developing device, a toner container, a container cover, a driver, a lock mechanism and a lock restricting portion. The lock mechanism is switched to a locking state for locking the container cover in a closed state and an unlocking state for causing the container cover to transition from the closed state to the open state. The lock restricting portion obstructs a state change of the lock mechanism from the unlocking state to the locking state if the container cover is not attached to the apparatus body.

8 Claims, 39 Drawing Sheets

IMAGE FORMING APPARATUS

INCORPORATION BY REFERENCE

This application is based on Japanese Patent Application No. 2019-100882 filed with the Japan Patent Office on May 30, 2019, the contents of which are hereby incorporated by reference.

BACKGROUND

Field of the Invention

The present disclosure relates to an image forming apparatus for forming an image on a sheet.

Related Art

Conventionally, an electrophotographic image forming apparatus such as a printer or copier includes a photoconductive drum for carrying an electrostatic latent image, a developing device for developing the electrostatic latent image into a toner image by supplying toner to the photoconductive drum and a transfer device for transferring the toner image from the photoconductive drum to a sheet.

Further, an image forming apparatus with a plurality of developing devices corresponding to respective colors of color toners is known to include toner containers for supplying replenishing toner to each developing device. Further, an apparatus body includes a body cover and a plurality of container covers arranged inside the body cover to allow each toner container to be attached and detached. If the body cover is opened, the plurality of container covers are exposed to outside. If the container cover is further opened, the toner container housed inside can be exchanged.

In the above technique, lock mechanisms are disclosed which lock the container covers in a closed state. The lock mechanism includes a drive source and a lock portion which can change a state between a locking state where the lock portion is driven by the drive source to lock the container cover and an unlocking state where the opening of the container cover is allowed.

SUMMARY

An image forming apparatus according to one aspect of the present disclosure includes an apparatus body, at least one image carrier, at least one developing device, a transfer unit, at least one toner container, a driver, at least one container cover, a lock mechanism and a lock restricting portion. The at least one image carrier is rotated about a predetermined axis and has a circumferential surface for carrying a toner image. The at least one developing device forms the toner image by supplying toner to the at least one image carrier. The transfer unit transfers the toner image carried on the at least one image carrier to a sheet. The at least one toner container includes a container body for storing replenishing toner to be replenished to the at least one developing device, and discharges the replenishing toner by the container body rotating in a first rotating direction about a predetermined rotation center axis while obstructing discharge of the replenishing toner by the container body rotating in a second rotating direction opposite to the first rotating direction about the rotation center axis. The driver generates a rotational drive force for selectively rotating the container body of the at least one toner container in the first rotating direction and the second rotating direction. The at least one container cover is openably and closably supported on the apparatus body to face the at least one toner container, and a state thereof is changeable between an open state where the at least one toner container is allowed to be attached to and detached from the apparatus body and a closed state where the at least one toner container is obstructed from being attached to and detached from the apparatus body. The lock mechanism is capable of switching a state between a locking state for locking the at least one container cover in the closed state and an unlocking state for allowing the state of the at least one container cover to be changed between the closed state and the open state. The lock restricting portion allows a state change of the lock mechanism from the unlocking state to the locking state if the at least one toner container is attached to the apparatus body and obstructs the state change of the lock mechanism from the unlocking state to the locking state if the at least one toner container is not attached to the apparatus body.

DETAILED DESCRIPTION

Figure 1:
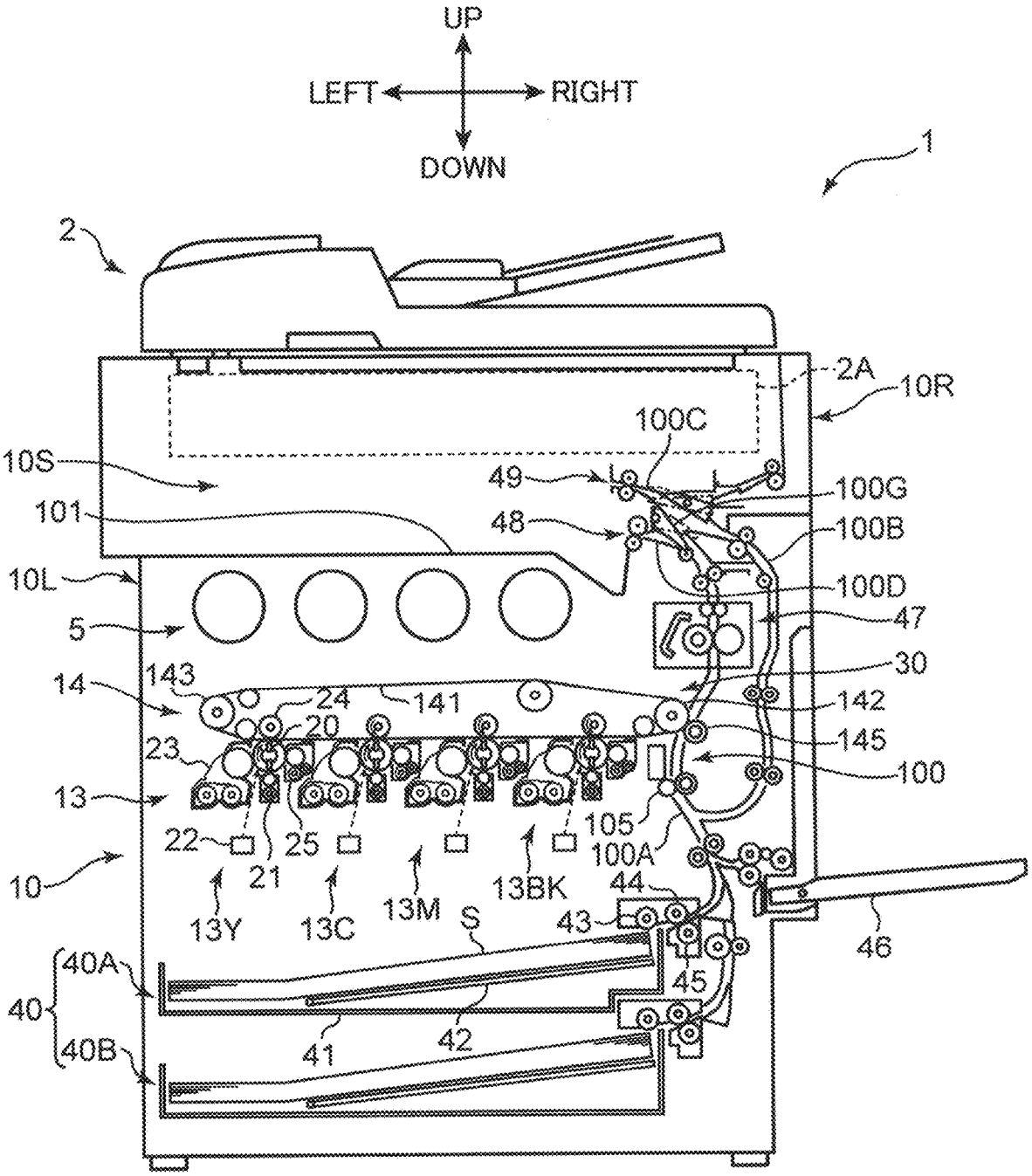
FIG. 1 is a sectional view showing an internal structure of an image forming apparatus according one embodiment of the present disclosure.

Hereinafter, one embodiment of the present disclosure is described with reference to the drawings. FIG. 1 is a sectional view showing an internal structure of an image forming apparatus 1 according to one embodiment of the present disclosure. Although a complex machine provided with a printer function and a copier function is illustrated as the image forming apparatus 1 here, an image forming apparatus may be a printer, a copier or a facsimile machine.

<Description of Image Forming Apparatus>

The image forming apparatus 1 includes an apparatus body 10 having a substantially rectangular parallelepiped housing structure and an automatic document feeder 2 arranged atop the apparatus body 10. The apparatus body 10 includes a body left wall 10L and a body right wall 10R. A reading unit 2A for optically reading a document image to be copied, an image forming station 30 for forming a toner image on a sheet, a fixing unit 47 for fixing the toner image to the sheet, a sheet feeding unit 40 for storing sheets to be conveyed to the image forming station 30 and a conveyance path 100 for conveying the sheet from the sheet feeding unit 40 or a sheet feed tray 46 to a discharge portion 101 of a discharge space 10S by way of a secondary transfer unit to be described later.

The automatic document feeder (ADF) 2 automatically feeds a document sheet to be copied toward a predetermined document reading position in the apparatus body 10. On the other hand, if a user manually places a document sheet at a predetermined document reading position, the ADF 2 is opened upward. The reading unit 2A optically reads an image on a document sheet automatically fed from the ADF 2 or a manually placed document sheet on the upper surface of the apparatus body 10. Note that, in another embodiment, the image forming apparatus 1 may be a printer not including the ADF 2 and the reading unit 2A.

The image forming station 30 forms an image on a sheet by generating a full-color toner image and transferring this toner image onto the sheet and includes an image forming unit 13 with four units 13Y, 13C, 13M and 13Bk tandemly arranged for forming toner images of yellow (Y), magenta (M), cyan (C) and black (Bk), an intermediate transfer unit 14 arranged above and adjacent to the image forming unit 13, and toner replenishing units 5 arranged above the intermediate transfer unit 14.

Each image forming unit 13Y, 13C, 13M, 13Bk includes a photoconductive drum 20 (image carrier) and a charger 21, an exposure device 22, a developing device 23, a primary transfer roller 24 and a cleaning device 25 arranged around this photoconductive drum 20.

The photoconductive drum 20 is rotated about a predetermined axis extending in a front-rear direction and has a circumferential surface for allowing an electrostatic latent image to be formed and carrying a toner image corresponding to the electrostatic latent image. The charger 21 uniformly charges the surface of the photoconductive drum 20. Note that the photoconductive drums 20 of the respective colors are arranged at predetermined intervals and adjacent to each other in a horizontal direction.

The exposure device 22 includes optical devices such as a laser light source, mirrors and lenses, and forms an electrostatic latent image on the circumferential surface of the photoconductive drum 20 by irradiating light based on image data of a document image.

The developing device 23 supplies toner to the circumferential surface of the photoconductive drum 20 and forms a toner image on the photoconductive drum 20 to develop the electrostatic latent image formed on the photoconductive drum 20 (make the electrostatic latent image visible). The primary transfer roller 24 primarily transfers the toner image on the photoconductive drum 20 onto an intermediate transfer belt 141. The cleaning device 25 cleans the circumferential surface of the photoconductive drum 20 after the transfer of the toner image.

The intermediate transfer unit 14 includes the intermediate transfer belt 141, a belt drive roller 142 and a driven roller 143. The intermediate transfer belt 141 is supported to be able to turn above a plurality of the photoconductive drums 20. Toner images are transferred (received) in an overlapping manner (in a superimposing manner) at the same position on the outer peripheral surface of the intermediate transfer belt 141. As a result, the intermediate transfer belt 141 carries the toner images of a plurality of colors. The intermediate transfer belt 141 is rotated counterclockwise in FIG. 1.

A secondary transfer roller 145 is arranged to face the circumferential surface of the belt drive roller 142. The secondary transfer roller 145 forms, together with the belt drive roller 142, a secondary transfer unit for transferring a full-color toner image superimposed (carried) on the intermediate transfer belt 141 to a sheet. Specifically, the intermediate transfer unit 14 and the secondary transfer roller 145 transfer the toner images carried on the plurality of photoconductive drums 20 to the sheet S.

The toner replenishing units 5 are arranged above the intermediate transfer belt 141 and supply the toners of the respective colors to the developing devices 23 of the image forming units 13Y, 13C, 13M and 13B corresponding to the respective colors through unillustrated supply paths.

The fixing unit 47 is a fixing device of an induction heating type for performing a fixing process of fixing the toner image to the sheet S, and a fixing nip portion is formed inside. By the passage of the sheet S through the fixing nip portion, the toner image transferred to the sheet S is fixed to this sheet.

The sheet feeding unit 40 includes sheet cassettes 40A, 40B in two stages for storing sheets S to which an image forming process is applied. These sheet cassettes 40A, 40B can be pulled out forwardly from the front of the apparatus body 10.

The sheet cassette 40A (40B) includes a sheet storage portion 41 for storing a sheet bundle formed by stacking the sheets S, and a lift plate 42 for lifting up the sheet bundle for sheet feeding. A pickup roller 43 and a pair of rollers including a sheet feed roller 44 and a retard roller 45 are arranged above a right end side of the sheet cassette 40A (40B). By driving the pickup roller 43 and the sheet feed roller 44, the uppermost sheet S of the sheet bundle in the sheet cassette 40A is fed one by one and carried into an upstream end of the conveyance path 100.

The conveyance path 100 includes a main conveyance path 100A for conveying the sheet S from the sheet feeding unit 40 to an exit of the fixing unit 47 by way of the image forming station 30, an inverting conveyance path 100B for returning the sheet S having one side printed to the image forming station 30 in the case of performing two-sided printing on the sheet S, and an upper conveyance path 100C and a lower conveyance path 100D for conveying the sheet S from a downstream end of the main conveyance path 100 toward the discharge space 10S. A pair of upper discharge rollers 49 are rotatably provided at a downstream end of the upper conveyance path 100C, and a pair of lower discharge rollers 48 are rotatably provided at a downstream end of the lower conveyance path 100D.

Further, the image forming apparatus 1 includes a guide unit 100G (FIG. 1). The guide unit 100G is pivotably supported in the apparatus body 10 and guides the sheet S having the fixing process applied thereto toward the pair of lower discharge rollers 48 or the pair of upper discharge rollers 49.

A pair of registration rollers 105 are arranged on a side of the main conveyance path 100A upstream of the secondary transfer roller 145. The sheet S is temporarily stopped at the pair of registration rollers 105 in a stopped state for skew correction. Thereafter, the pair of registration rollers 105 are rotationally driven by a drive motor (not shown) at a predetermined timing for image transfer, whereby the sheet S is fed to the secondary transfer roller 145.

<Concerning Toner Replenishing Units>

Figure 2:
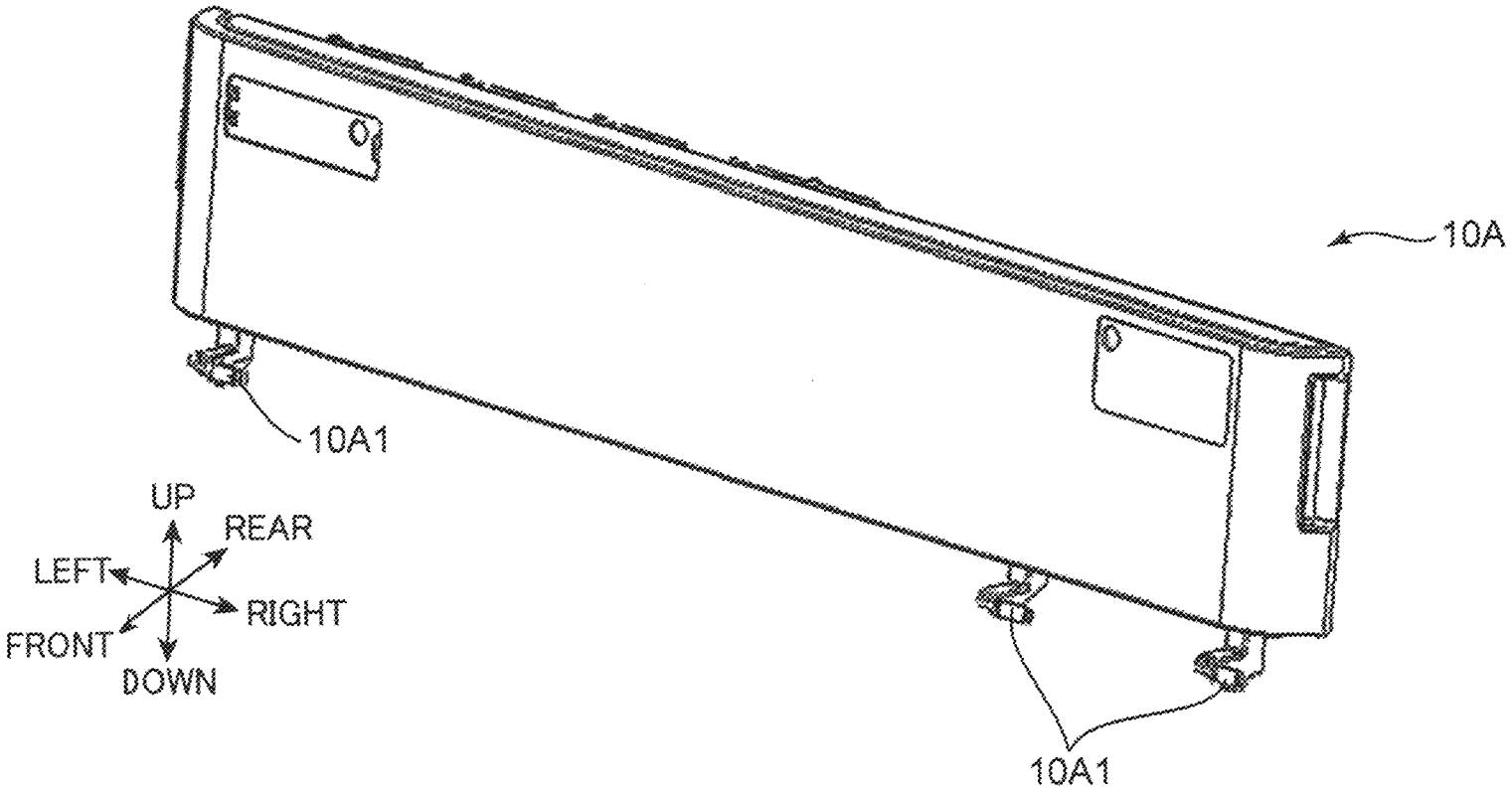
FIG. 2 is a perspective view of a front cover of the image forming apparatus according to the one embodiment of the present disclosure.
Figure 3:
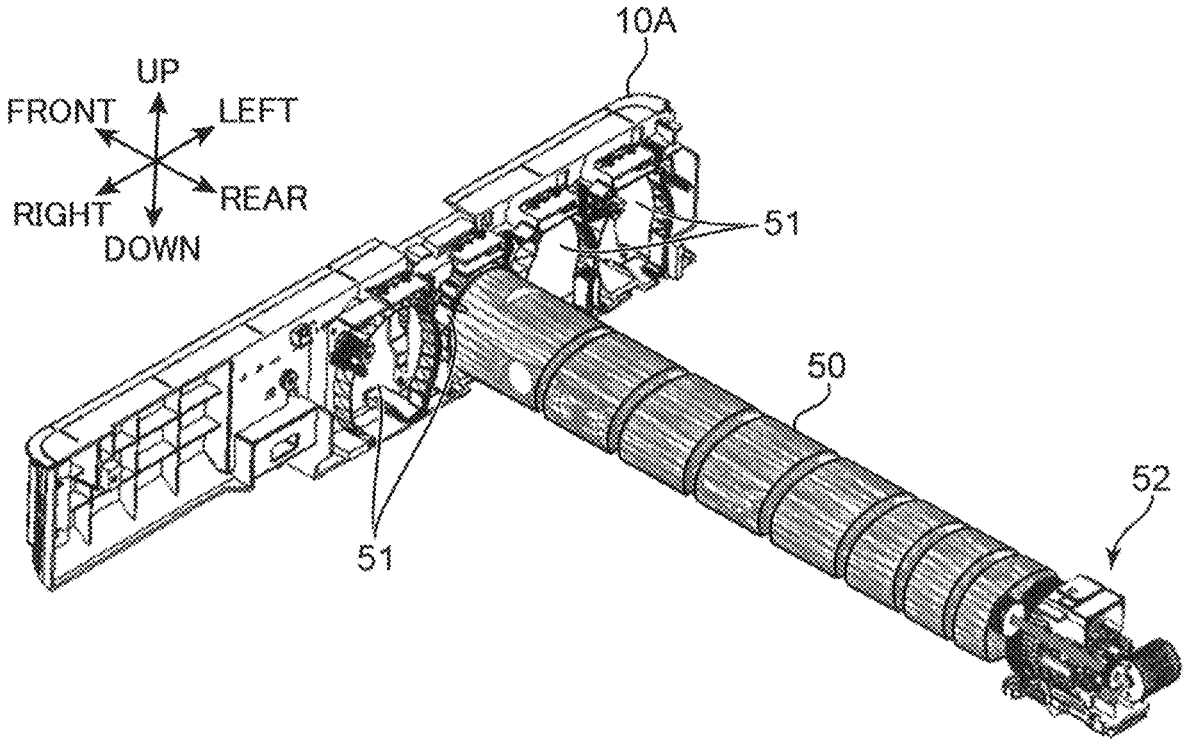
FIG. 3 is a perspective view of the front cover, container covers, a toner container and a container driver of the image forming apparatus according to the one embodiment of the present disclosure.
Figure 4:
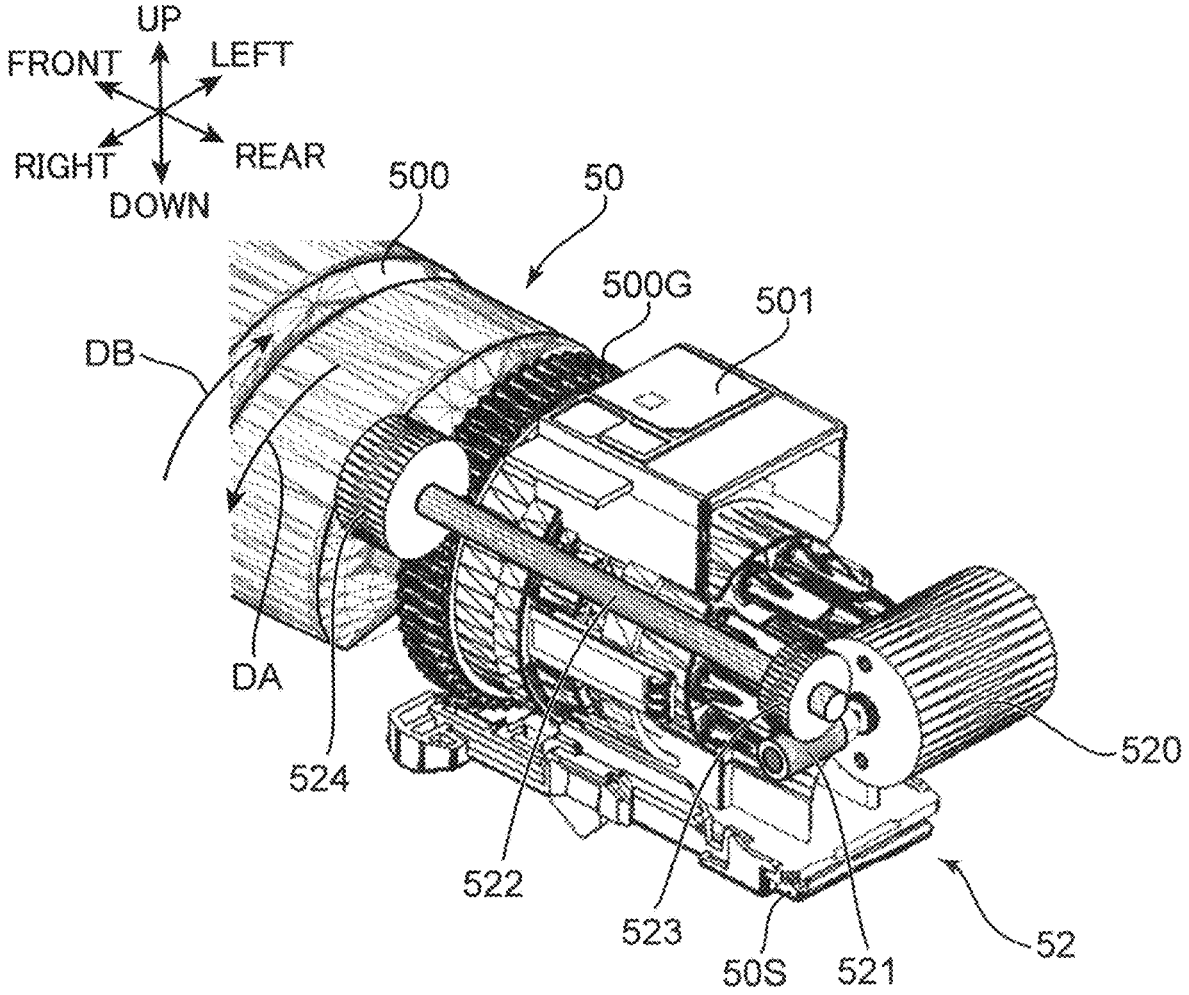
FIG. 4 is a perspective view of the container driver of the image forming apparatus according to the one embodiment of the present disclosure.
Figure 5A:
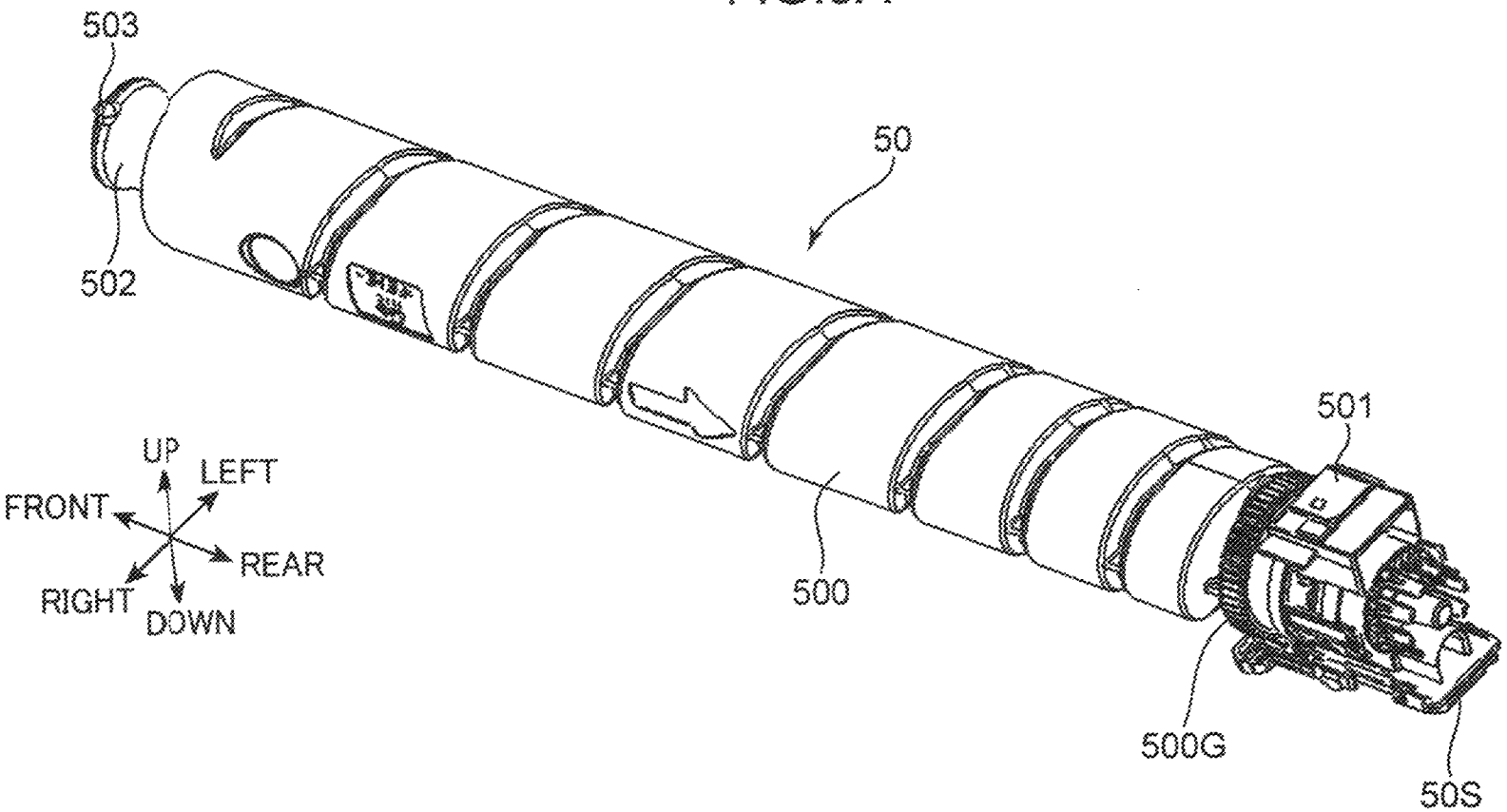
FIG. 5A is a perspective view of the toner container of the image forming apparatus according to the one embodiment of the present disclosure.
Figure 5B:
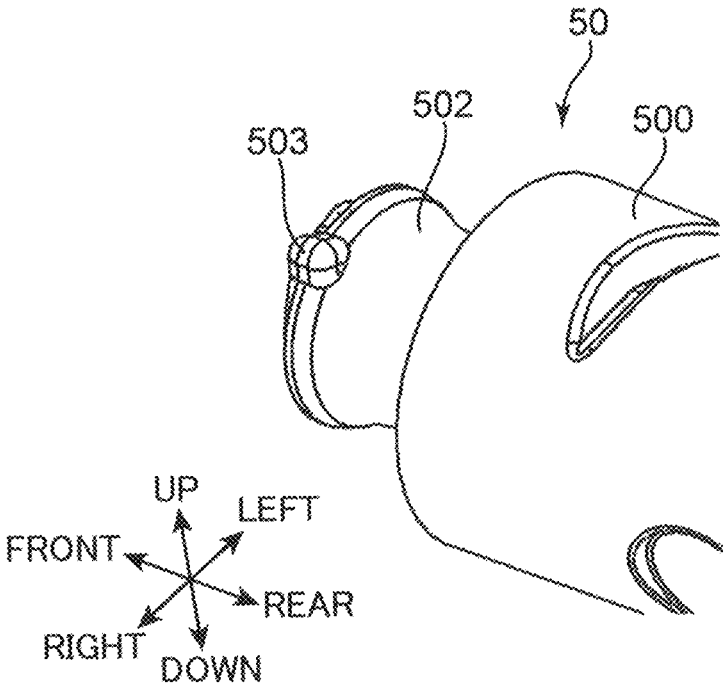
FIG. 5B is an enlarged perspective view of the toner container of the image forming apparatus according to the one embodiment of the present disclosure.
Figure 6:
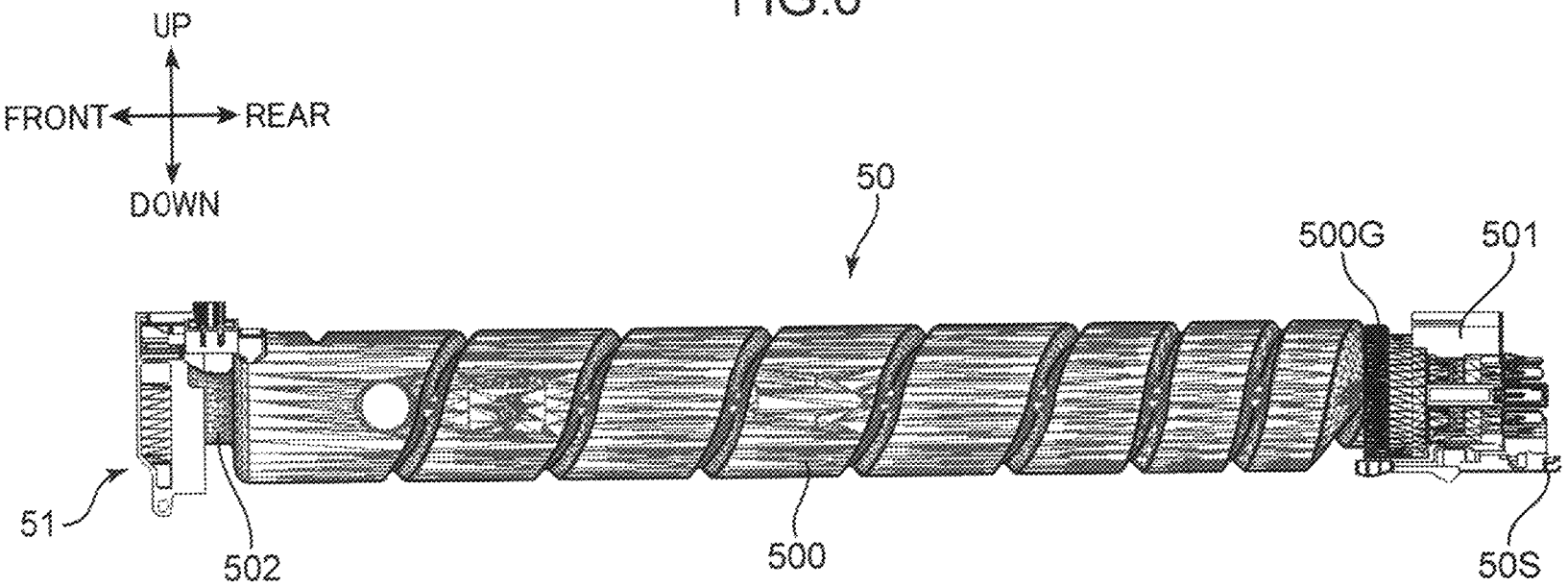
FIG. 6 is a side view of the toner container and the container cover of the image forming apparatus according to the one embodiment of the present disclosure.
Figure 7:
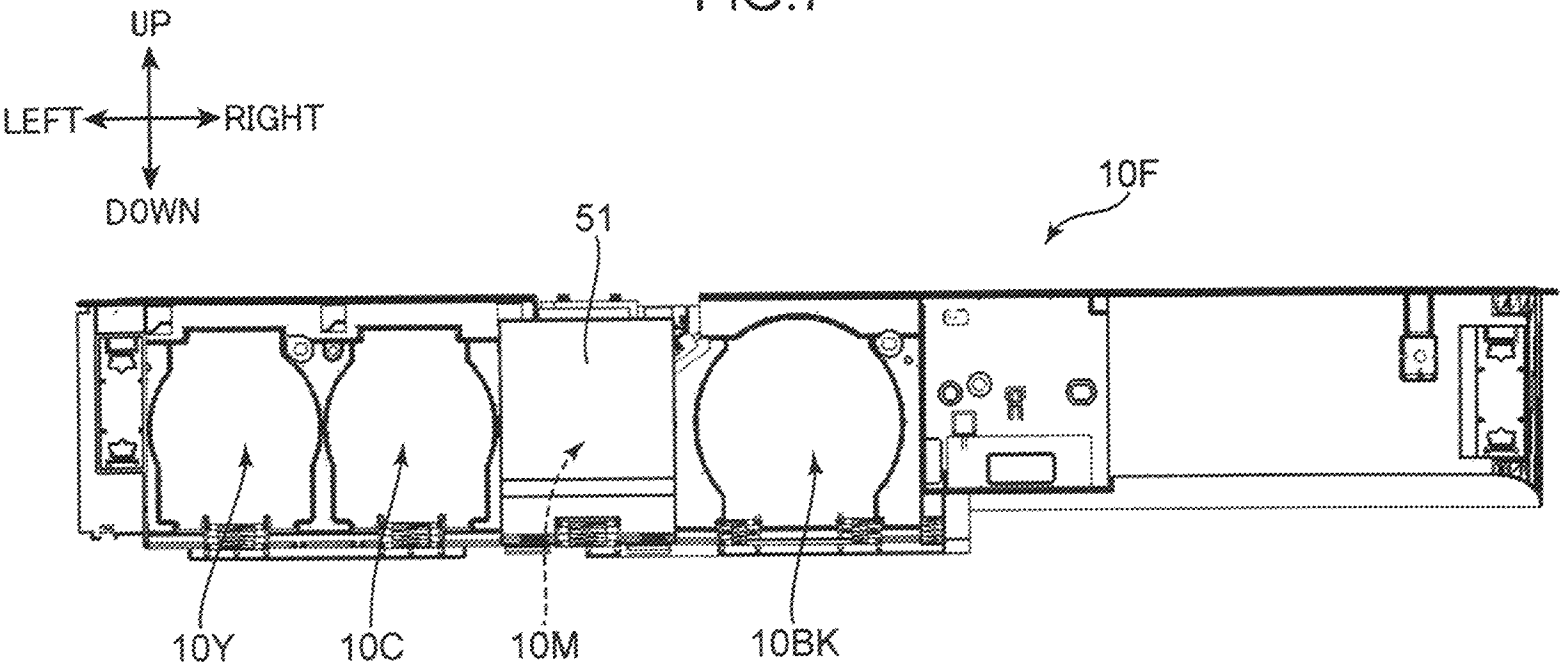
FIG. 7 is a front view of a front frame and the container cover of the image forming apparatus according to the one embodiment of the present disclosure.

Next, the structures of the toner replenishing units 5 of FIG. 1 are described. FIG. 2 is a perspective view of a front cover 10A of the image forming apparatus 1 according to this embodiment. FIG. 3 is a perspective view of the front cover 10A, container covers 51, a toner container 50 and a container driver 52 of the image forming apparatus 1 according to this embodiment. FIG. 4 is a perspective view of the container driver 52 of the image forming apparatus 1 according to this embodiment. FIG. 5A is a perspective view of the toner container 50 according to this embodiment, and FIG. 5B is an enlarged perspective view of the toner container 50. FIG. 6 is a side view of the toner container 50 and the container cover 51 according to this embodiment. FIG. 7 is a front view of a front frame 10F and the container cover 51 according to this embodiment.

The apparatus body 10 of the image forming apparatus 1 includes the front cover 10A and the front frame 10F (see FIG. 7). Further, the toner replenishing units 5 include four toner containers 50 corresponding to the respective colors, four container covers 51 corresponding to the respective colors and four container drivers 52 (driver) corresponding to the respective colors. Note that one toner container 50 and one container driver 52 are shown for the four container covers 51 in FIG. 3. Specifically, the other three toner containers 50 and container drivers 52 are not shown. Since internal structures of the toner replenishing units 5 of the respective colors are identical to each other, the toner replenishing unit 5 of magenta is described below.

The front cover 10A is openable and closable with respect to the apparatus body 10. The front frame 10F is fixed to the apparatus body 10 inside the front cover 10A. The front cover 10A has three supporting point portions 10A1. The three supporting point portions 10A1 are rotatably supported on the apparatus body 10. If the front cover 10A is opened forward with respect to the front frame 10F (apparatus body 10), the four container covers 51 located inside (rearward of) the front cover 10A are exposed on the front of the apparatus body 10. Note that, out of the four container covers 51, one container cover 51 is shown in FIG. 7. In the front frame 10F, a yellow attaching portion 10Y, a cyan attaching portion 10C, a magenta attaching portion 10M and a black attaching portion 10Bk to which the toner containers 50 of the respective colors are attachable are open to respectively face the four container covers 51. By inserting the toner containers 50 of the respective colors into these attaching portions (openings), the toner containers 50 of the respective colors are attached to the apparatus body 10.

The four container covers 51 are arranged adjacent to each other in a lateral direction between the front cover 10A and the front frame 10F. Each container cover 51 is openably and closably supported on the front frame 10F to face the corresponding toner container 50. Each container cover 51 can change a state between an open state where the toner container 50 of each color is allowed to be attached to and detached from the apparatus body 10 and a closed state where the attachment and detachment of the toner container 50 of each color to and from the apparatus body 10 are obstructed.

The toner container 50 stores replenishing toner to be replenished to the developing device 23 of each color. Specifically, the toner container 50 includes a container body 500, a container fixing portion 501, a grip portion 502 and a projection 503 (container projection).

The container body 500 has a hollow cylindrical shape to store the replenishing toner inside. A spiral groove is formed in the outer circumferential surface of the container body 500. As a result, a spiral projection is formed to correspond to the spiral groove on the inner circumferential surface of the container body 500. A container gear 500G (FIG. 4) is formed on a rear end part of the outer circumferential surface of the container body 500.

The container fixing portion 501 is connected to a rear end part of the container body 500. The container fixing portion 501 is fixed inside the apparatus body 10. In other words, the container body 500 relatively rotates with respect to the container fixing portion 501. An unillustrated space communicating with a hollow cylindrical interior of the container body 500 is formed inside the container fixing portion 501. Further, a container shutter 50S slidable in the front-rear direction is arranged on a low surface part of the container fixing portion 501. The container shutter 50S opens and seals an unillustrated toner discharge port formed in the lower surface part of the container fixing portion 501. If the toner container 50 is attached to the apparatus body 10, the above shutter is slid to open the toner discharge port. As a result, according to the rotation of the container body 500, the toner in the container body 500 is supplied from the toner discharge port to the developing device 23 through the container fixing portion 501.

The grip portion 502 is arranged on a front end part of the container body 500. The grip portion 502 has an outer diameter smaller than that of the container body 500. Further, the projection 503 is a projection radially projecting from a circumferential part of the grip portion 502.

The container body 500 discharges the replenishing toner from the toner discharge port by rotating in a first rotating direction DA (FIG. 4) about a predetermined rotation center axis extending in the front-rear direction while obstructing the discharge of the replenishing toner by rotating in a second rotating direction DB (FIG. 4) opposite to the first rotating direction about the rotation center axis.

The container driver 52 (FIG. 4) generates a rotational drive force for selectively rotating the container body 500 of the toner container 50 in the first and second rotating directions DA, DB. The container driver 52 includes a motor 520 having a motor output shaft 521, a shaft 522, a gear 523 and a gear 524. The motor 520 can rotate in forward and reverse directions. The motor output shaft 521 of the motor 520 is engaged with the gear 523 fixed to a rear end part of the shaft 522. On the other hand, the gear 524 is fixed to a front end part of the shaft 552 and engaged with the aforementioned container gear 500G. As a result, the container body 500 rotates in the first rotating direction DA via the container gear 500G if the motor 520 rotates in the forward direction, and the container body 500 rotates in the second rotating direction DB via the container gear 500G if the motor 520 rotates in the reverse direction.

Further, the toner replenishing units 5 include four lock mechanisms 51R (FIG. 17A) and four lock restricting portions 62 (FIG. 23) corresponding to the respective colors. A state of the lock mechanism 51R of each color can be switched between a locking state where the container cover 51 is locked in a closed state and an unlocking state where the container cover 51 is allowed to change the state between the closed state and an open state. The lock mechanism 51R maintains the locking state if the container body 500 is rotated in the first rotating direction DA by the container driver 52, and the state is switched from the locking state to the unlocking state by receiving a rotational drive force of the container driver 52 if the container body 500 is rotated in the second rotating direction DB by the container driver 52.

The lock mechanism 51R of each color includes a body lock portion 61, a first lever 512 and a second lever 513 in addition to the projection 503 provided on the aforementioned toner container 50. The projection 503 of the aforementioned container body 500 is arranged on the toner container 50 to face the container cover 51, and can be rotated in the first and second rotating directions DA, DB integrally with the container body 500. Further, the first and second levers 512, 513 are arranged on the container cover 51. The detailed structures of the container cover 51 and the periphery thereof are described below.

Figure 8A:
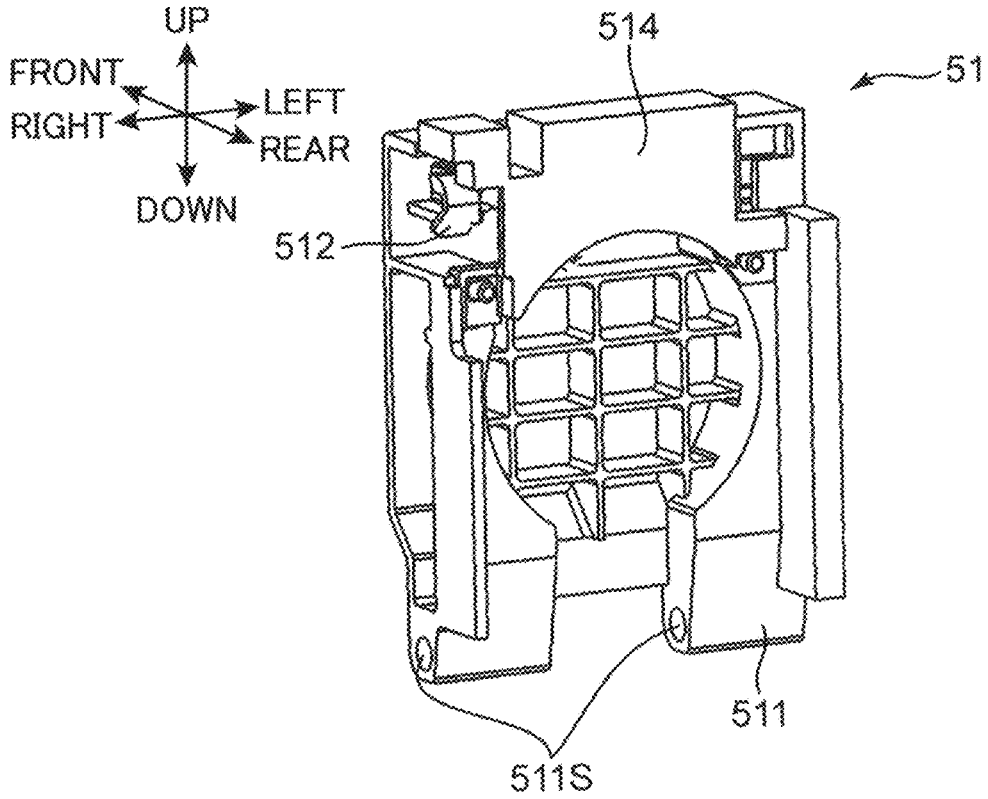
FIG. 8A is a perspective view of the container cover of the image forming apparatus according to the one embodiment of the present disclosure.
Figure 8B:
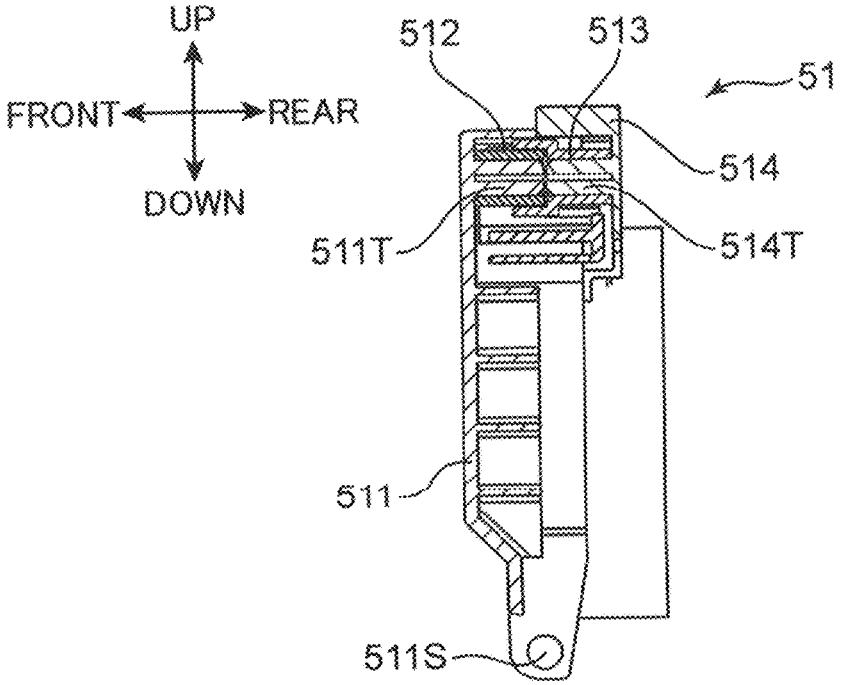
FIG. 8B is a side sectional view of the container cover of the image forming apparatus according to the one embodiment of the present disclosure.
Figure 9A:
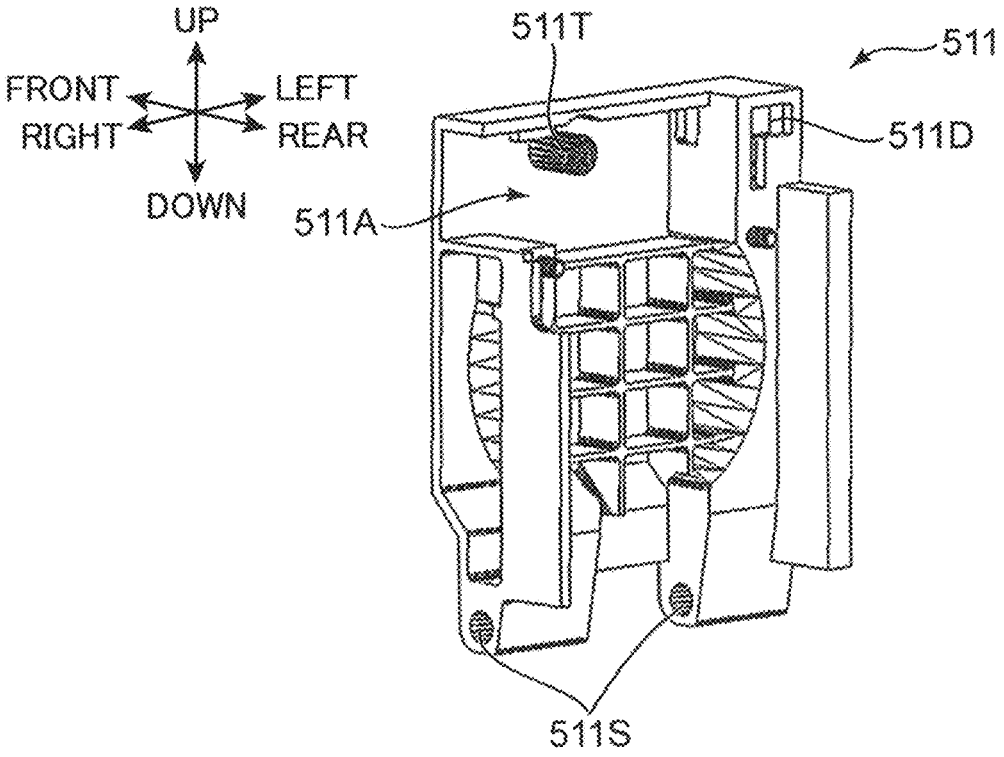
FIG. 9A is a perspective view of a cover body of the container cover of the image forming apparatus according to the one embodiment of the present disclosure.
Figure 9B:
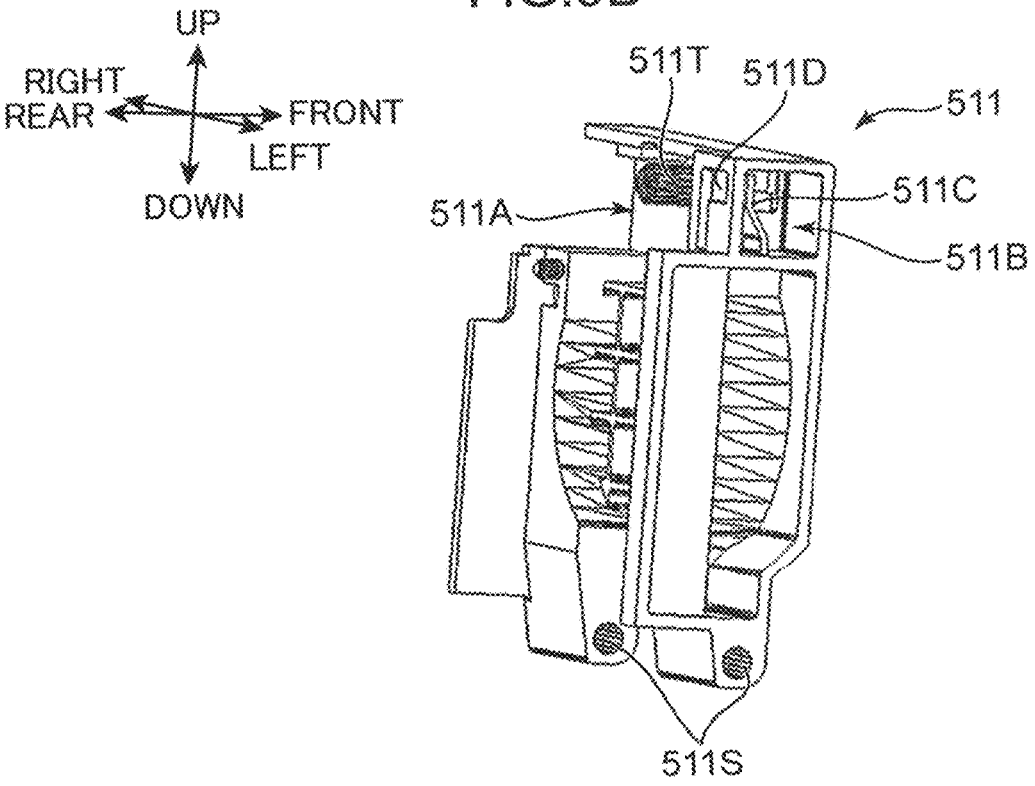
FIG. 9B is a perspective view of the cover body of the container cover of the image forming apparatus according to the one embodiment of the present disclosure.
Figure 9C:
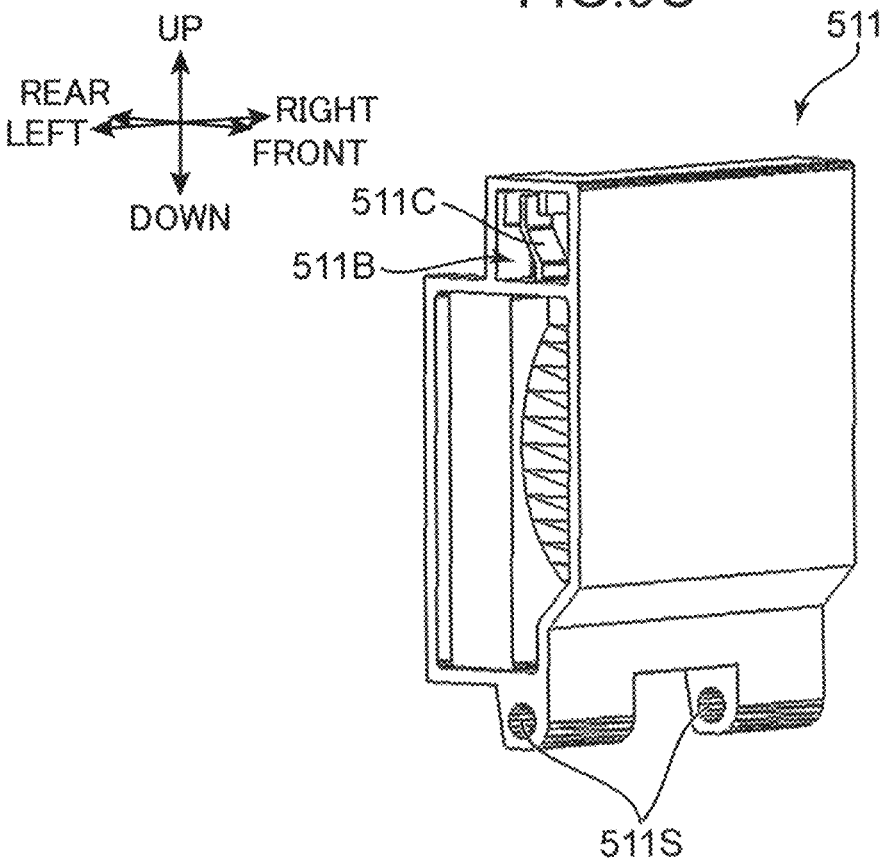
FIG. 9C is a perspective view of the cover body of the container cover of the image forming apparatus according to the one embodiment of the present disclosure.
Figure 10A:
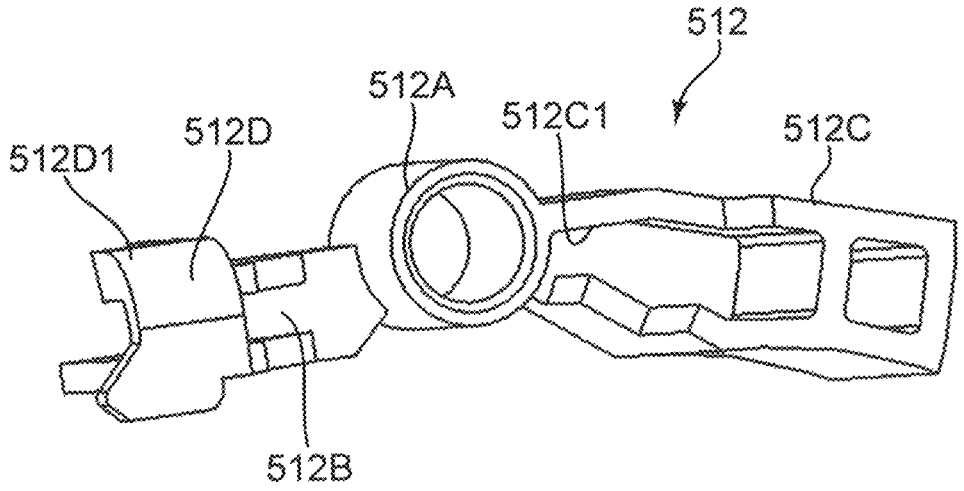
FIG. 10A is a perspective view of a first lever of the container cover of the image forming apparatus according to the one embodiment of the present disclosure.
Figure 10B:
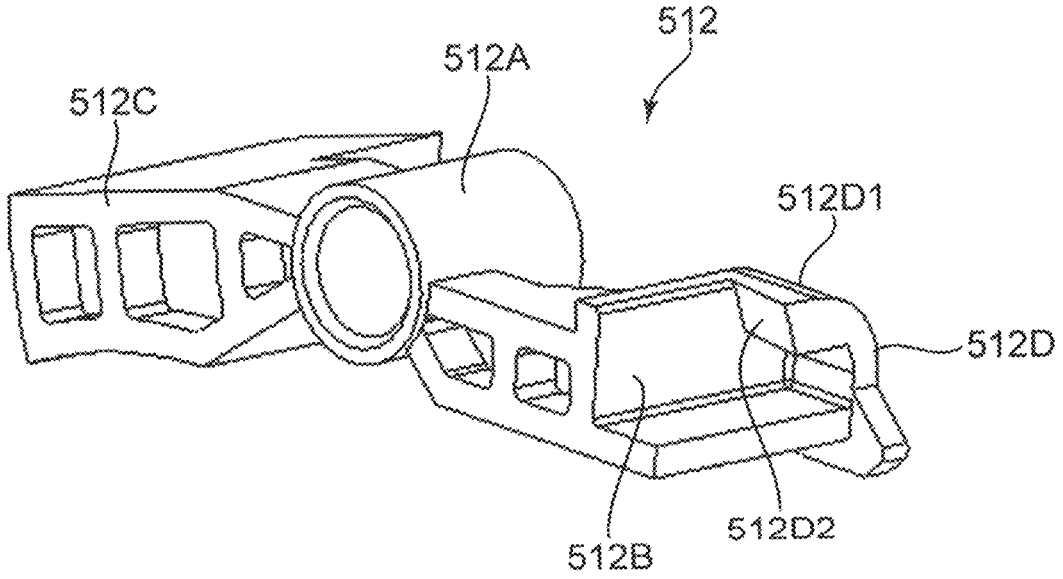
FIG. 10B is a perspective view of the first lever of the container cover of the image forming apparatus according to the one embodiment of the present disclosure.
Figure 11A:
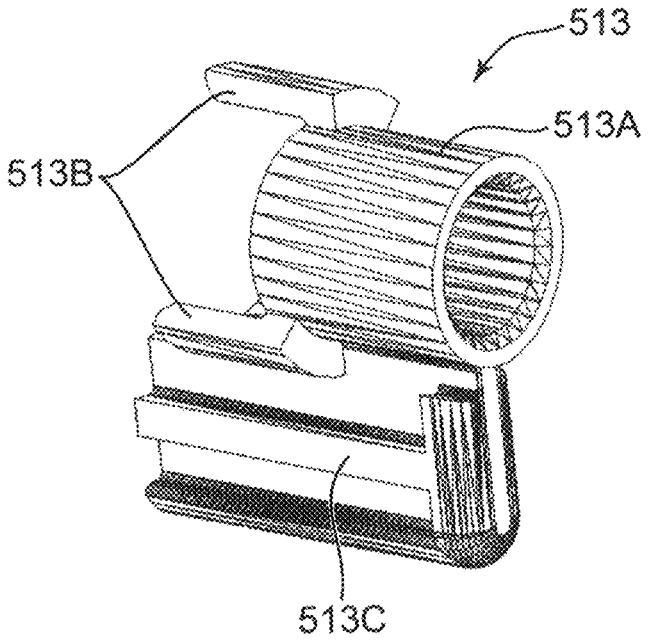
FIG. 11A is a perspective view of a second lever of the container cover of the image forming apparatus according to the one embodiment of the present disclosure.
Figure 11B:
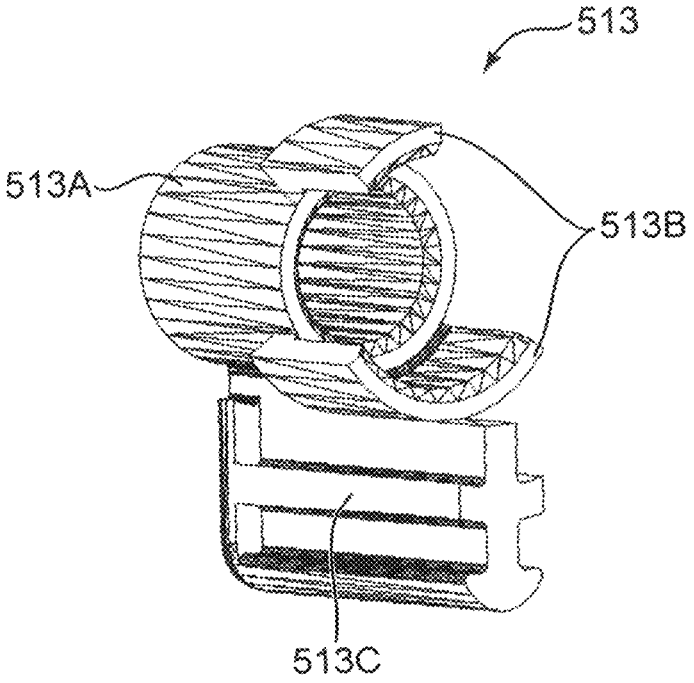
FIG. 11B is a perspective view of the second lever of the container cover of the image forming apparatus according to the one embodiment of the present disclosure.
Figure 11C:
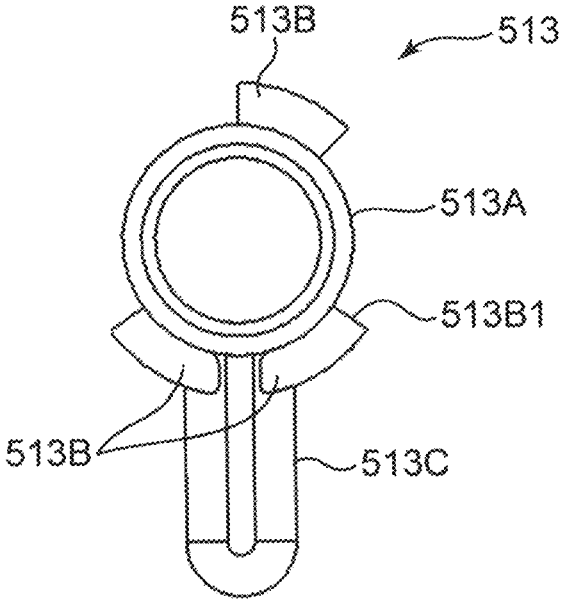
FIG. 11C is a back view of the second lever of the container cover of the image forming apparatus according to the one embodiment of the present disclosure.

FIGS. 8A and 8B are a perspective view and a side sectional view of the container cover 51 of the image forming apparatus 1 according to this embodiment. FIGS. 9A, 9B and 9C are perspective views of a cover body 511 of the container cover 51 of the image forming apparatus 1 according to this embodiment. FIGS. 10A and 10B are perspective views of the first lever 512 of the container cover 51 of the image forming apparatus 1 according to this embodiment. FIGS. 11A, 11B and 11C are perspective views of the second lever 513 of the container cover 51 of the image forming apparatus 1 according to this embodiment.

The container cover 51 includes the cover body 511, the first lever 512, the second lever 513 and an auxiliary cover 514.

The cover body 511 is a body part of the container cover 51 and formed by resin molding. The cover body 511 includes cover supporting point portions 511S, a lever housing portion 511A, a shaft portion 511T, a box-shaped portion 511*b*, a pressed piece 511C and an opening 511D.

The cover supporting point portions 511S are bearing portions formed in a lower end part of the cover body 511, and receive unillustrated support shafts projecting on the front frame 10F. As a result, the cover supporting point portions 511S serve as a fulcrum in the rotation of the container cover 51.

The lever housing portion 511A is a space portion formed on the underside of an upper end part of the cover body 511. The first and second levers 512, 513 are housed in the lever housing portion 511A. The shaft portion 511T is a shaft projecting from the underside of the cover body 511 in the lever housing portion 511A. The shaft portion 511T pivotably supports the first and second levers 512, 513 and forms a rotation center axis in pivoting movements of the first and second levers 512, 513.

The box-shaped portion 511B is formed adjacent to the lever housing portion 511A on the underside of the cover body 511. The pressed piece 511C is arranged inside the box-shaped portion 511B. A lower end part of the pressed piece 511C is fixed to a lower surface part of the box-shaped portion 511B. An upper end part of the pressed piece 511C is a free end. As a result, the pressed piece 511C is elastically deformable in the front-rear direction. Note that the left side surface of the box-shaped portion 511B is open as shown in FIGS. 9B and 9C. Further, the opening 511D is formed in the rear side surface of the box-shaped portion 511B.

With reference to FIGS. 10A and 10B, the first lever 512 is supported on the shaft portion 511T (FIG. 9A) to be pivotable about a rotation center axis extending in the front-rear direction. The first lever 512 includes a first hollow cylindrical portion 512A, a first arm 512B and a second arm 512C. The first hollow cylindrical portion 512A is externally fit on the shaft portion 511T. The first arm 512B extends leftward from the first hollow cylindrical portion 512A. A lever lock portion 512D (lock portion) is arranged on a tip part of the first arm 512B. The lever lock portion 512D includes an inclined portion 512D1 formed by a curved surface. The lever lock portion 512D is engaged with an engaging portion 613 of the body lock portion 61 in the locking state of the lock mechanism 51R while being disengaged from the engaging portion 613 in the unlocking state of the lock mechanism 51R. The second arm 512C extends rightward from the first hollow cylindrical portion 512A. The second arm 512C includes a first pressed portion 512C1. The first pressed portion 512C1 is pressed upwardly by a pressing portion 513B1 of the second lever 513.

With reference to FIGS. 11A, 11B and 11C, the second lever 513 is supported on the shaft portion 511T (FIG. 9A) of the cover body 511 to be pivotable about a rotation center axis extending in the front-rear direction. Note that, in this embodiment, the rotation center axis of the first lever 512 and that of the second lever 513 are arranged on the same axis. The second lever 513 includes a second hollow cylindrical portion 513A, a bearing 513B and a second pressed portion 513C (contact portion). The second hollow cylindrical portion 513A is externally fit on a shaft portion 514T (FIG. 8B) projecting on the auxiliary cover 514. The bearing 513B is a bearing formed around a center axis of the second hollow cylindrical portion 513A. The bearing 513B is composed of two members (fan-shaped members) arranged while being circumferentially spaced apart. The pressing portion 513B1 (FIG. 11C) (pivoting/pressing portion) is arranged on a side surface of one of the two fan-shaped members. The bearing 513B is externally fit on the first hollow cylindrical portion 512A of the first lever 512. The second pressed portion 513C is a projecting piece arranged to extend upward from the second hollow cylindrical portion 513A and the bearing 513B. The second pressed portion 513C comes into contact with the projection 503 of the toner container 50.

Figure 12A:
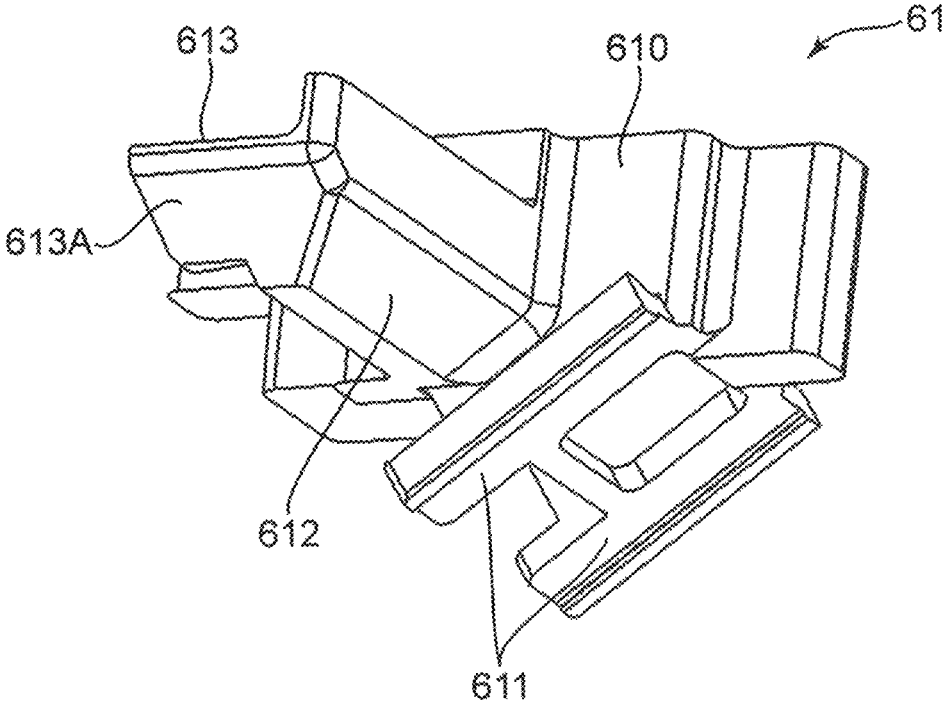
FIG. 12A is a perspective view of a body lock portion of the image forming apparatus according to the one embodiment of the present disclosure.
Figure 12B:
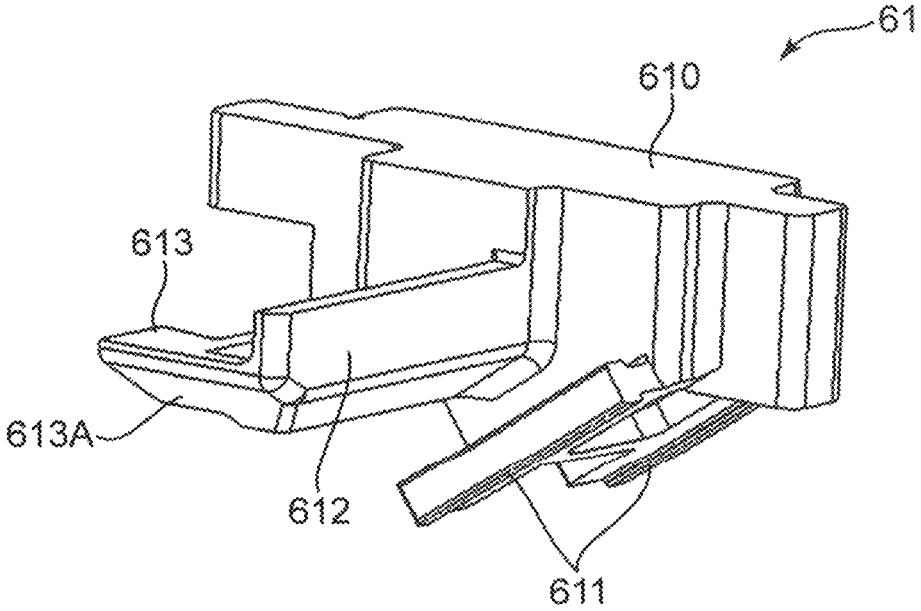
FIG. 12B is a perspective view of the body lock portion of the image forming apparatus according to the one embodiment of the present disclosure.
Figure 12C:
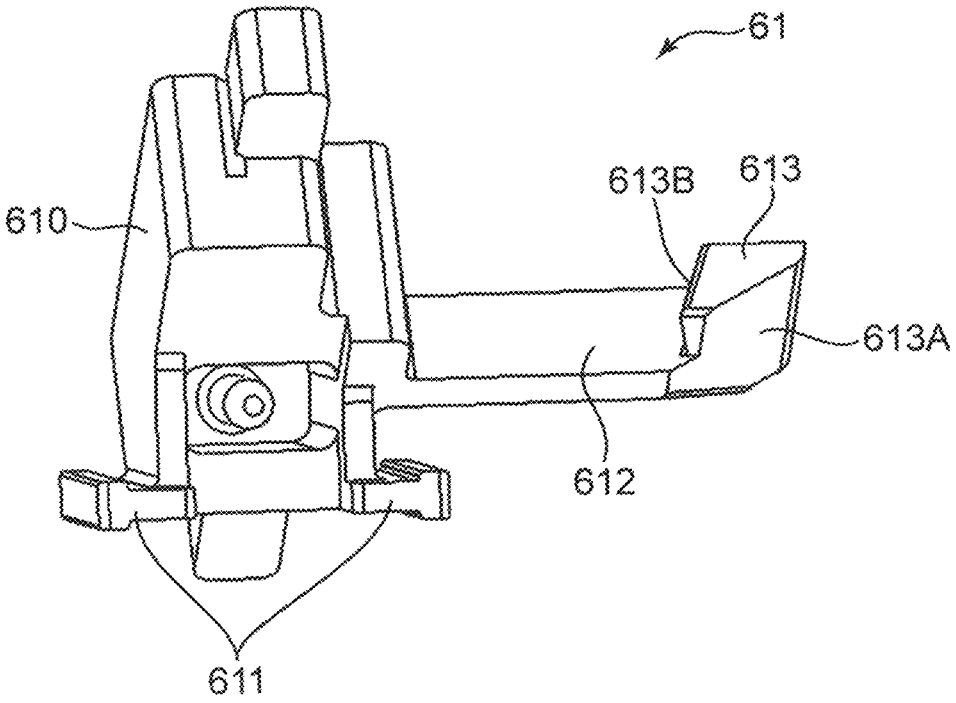
FIG. 12C is a perspective view of the body lock portion of the image forming apparatus according to the one embodiment of the present disclosure.
Figure 13A:
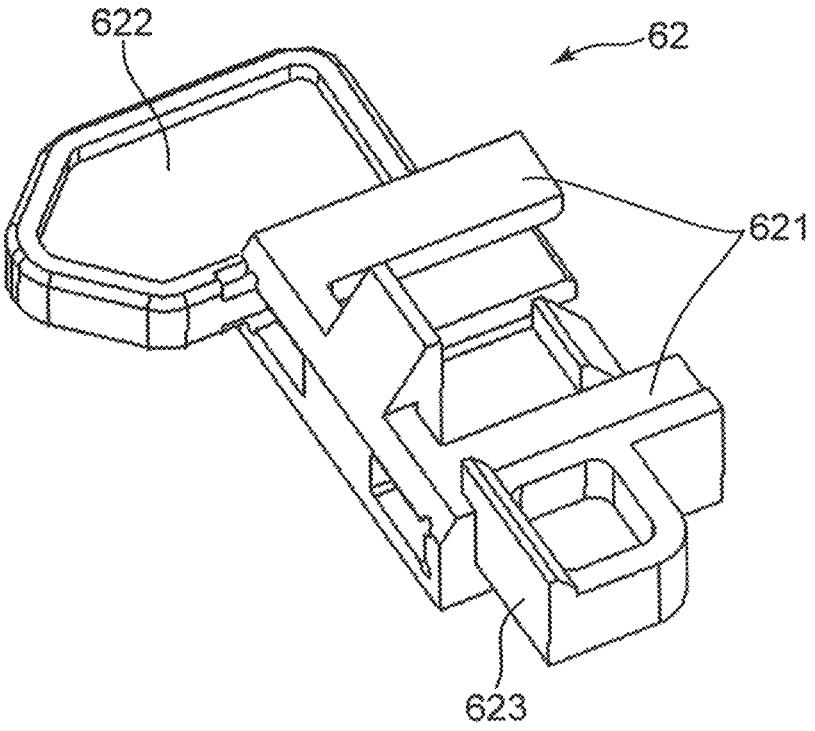
FIG. 13A is a perspective view of a lock restricting portion of the image forming apparatus according to the one embodiment of the present disclosure.
Figure 13B:
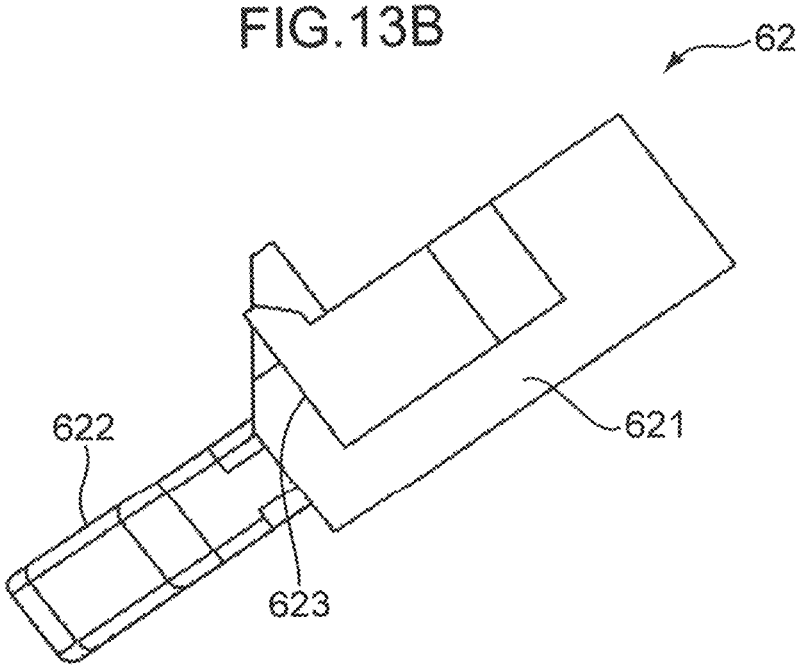
FIG. 13B is a side view of the lock restricting portion of the image forming apparatus according to the one embodiment of the present disclosure.

FIGS. 12A, 12B and 12C are perspective views of the body lock portion 61 of the image forming apparatus 1 according to this embodiment. Further, FIGS. 13A and 13B are a perspective view and a side view of the lock restricting portion 62 of the image forming apparatus 1 according to this embodiment.

The body lock portion 61 is mounted on the front frame 10F of the apparatus body 10. The body lock portion 61 includes a lock body 610, guide portions 611, a projection 612 and an engaging portion 613. The lock body 610 is a body part of the body lock portion 61. The guide portion 611 is arranged on a lower end part of the lock body 610. The guide portion 611 is inclined to extend from a right-upper side toward a left-lower side. The guide portions 611 guide a sliding movement of the lock restricting portion 62 to be described later. Particularly, the guide portions 611 guide the lock restricting portion 62 to a predetermined separated position if the toner container 50 is attached to the apparatus body 10 and an outer peripheral part of the toner container 50 comes into contact with a third pressed portion 622 of the lock restricting portion 62, and guide the lock restricting portion 62 to a predetermined interposed position if the toner container 50 is not attached to the apparatus body 10. If the body lock portion 61 is mounted on the front frame 10F, the projection 612 is arranged to extend forward from the lock body 610. The engaging portion 613 is arranged on a tip part of the projection 612. The engaging portion 613 functions to hold the container cover 51 in the closed state. The engaging portion 613 is shaped by bending a tip part of the projection 612 in a horizontal direction (leftward direction). The engaging portion 613 has a sliding slope 613A and an engaged surface 613B. The sliding slope 613A is constituted by a lower surface part of the engaging portion 613, and inclined to extend toward a rear-lower side.

The lock restricting portion 62 is slidably mounted on the body lock portion 61. The lock restricting portion 62 includes guided portions 621, the third pressed portion 622 (container contact portion), and a restricting piece 623 (interposing portion). The guided portions 621 are slidably held on the guide portions 611 of the above body lock portion 61. The third pressed portion 622 is connected to rear side parts of the guided portions 621. The third pressed portion 622 is constituted by a plate-like member having a substantially pentagonal shape, and includes a triangular tip part. The tip part of the third pressed portion 622 can come into contact with the outer circumferential surface of the container body 500 of the toner container 50. The restricting piece 623 is connected to front parts of the guided portions 621. The restricting piece 623 can be interposed between the lever lock portion 512D of the first lever 512 and the engaging portion 613. The restricting piece 623 allows the state of the lock mechanism 51R to be changed from the unlocking state to the locking state if the toner container 50 is attached to the apparatus body 10, and obstructs a state change of the lock mechanism 51R from the unlocking state to the locking state if the toner container 50 is not attached to the apparatus body 10. Thus, the lock restricting portion 62 is made movable between the separated position where the restricting piece 623 is arranged away from a position between the lever lock portion 512D and the engaging portion 613 and the interposed position where the restricting piece 623 is interposed between the lever lock portion 512D and the engaging portion 613 by the guide portions 611 of the body lock portion 61.

Figure 14A:
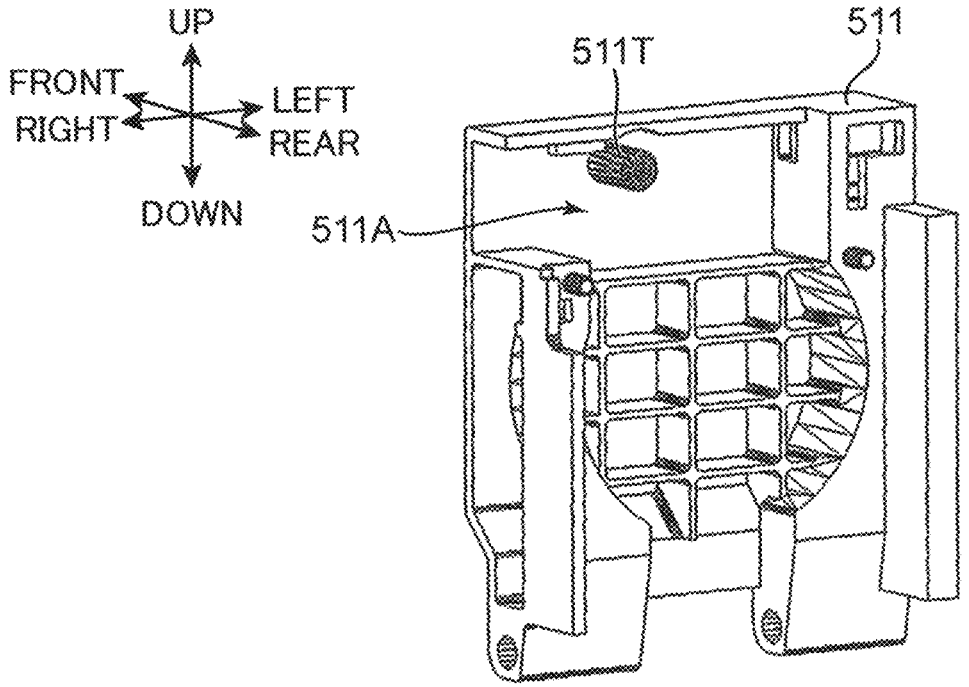
FIG. 14A is an assembly process diagram of the container cover of the image forming apparatus according to the one embodiment of the present disclosure.
Figure 14B:
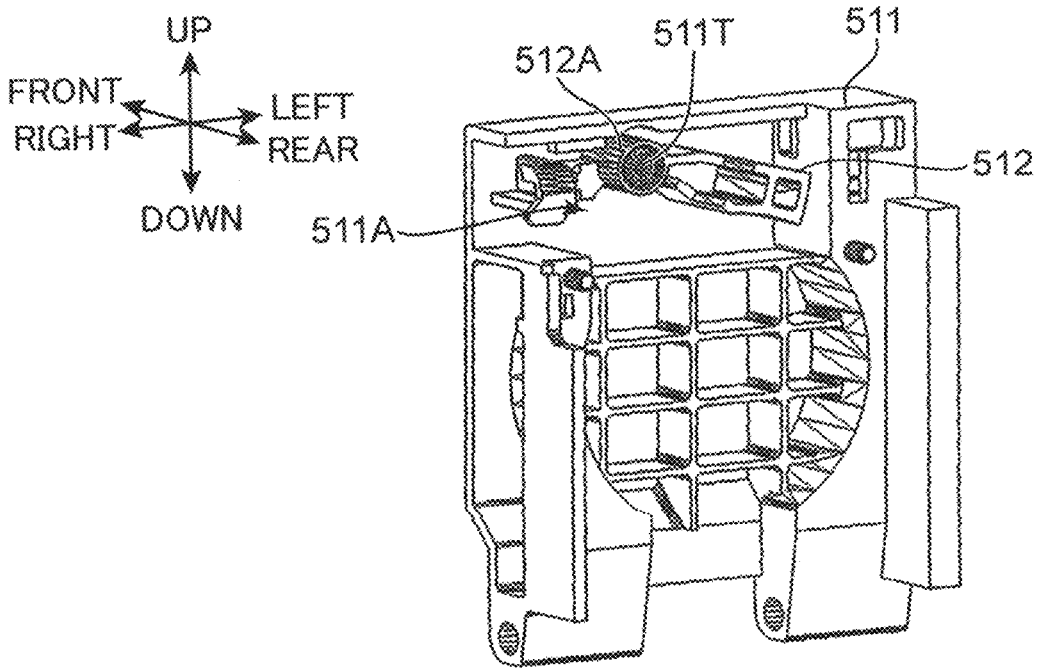
FIG. 14B is an assembly process diagram of the container cover of the image forming apparatus according to the one embodiment of the present disclosure.
Figure 14C:
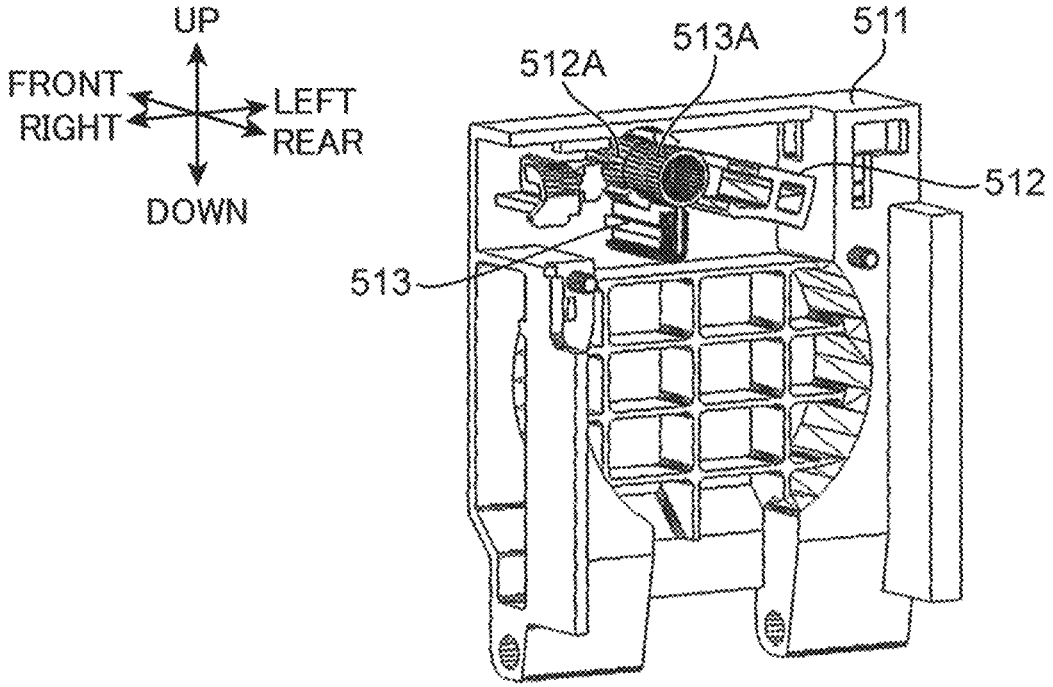
FIG. 14C is an assembly process diagram of the container cover of the image forming apparatus according to the one embodiment of the present disclosure.
Figure 14D:
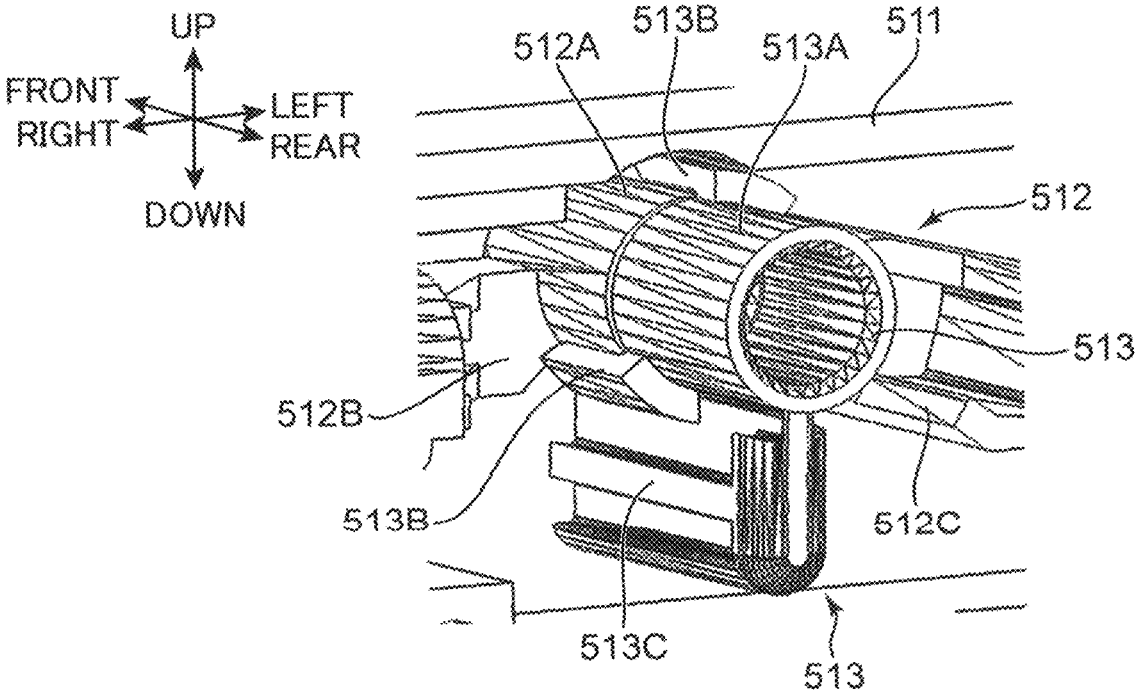
FIG. 14D is an enlarged perspective view enlargedly showing a part of FIG. 14C.

FIGS. 14A, 14B and 14C are assembly process diagrams of the container cover 51 of the image forming apparatus 1 according to this embodiment. FIG. 14D is an enlarged perspective view enlargedly showing a part of FIG. 14C.

In an assembly process of the container cover 51, the first lever 512 is arranged in the lever housing portion 511A of the cover body 511 as shown in FIGS. 14A and 14B. At this time, the first hollow cylindrical portion 512A of the first lever 512 is externally fit on the shaft portion 511T, whereby the first lever 512 is pivotably supported on the shaft portion 511T. Subsequently, as shown in FIGS. 14C and 14D, the second hollow cylindrical portion 513A of the second lever 513 is externally fit on the first hollow cylindrical portion 512A of the first lever 512. As a result, the second lever 513 is pivotably supported on the shaft portion 511T via the first lever 512. The first arm 512B of the first lever 512 extends rightward and the second arm 512C extends leftward with respect to the shaft portion 511T. Further, the second pressed portion 513C of the second lever 513 extends downward with respect to the shaft portion 511T. Thereafter, the auxiliary cover 514 is mounted on the cover body 511 to cover the lever housing portion 511A of the cover body 511 from behind (FIG. 8A). Thereafter, the cover supporting point portions 511S of the cover body 511 are mounted on support shafts 10H (see FIG. 15) of the front frame 10F, whereby the container cover 51 is openably and closably supported on the front frame 10F. Note that the same applies also to the container covers 51 of the other colors.

Figure 15:
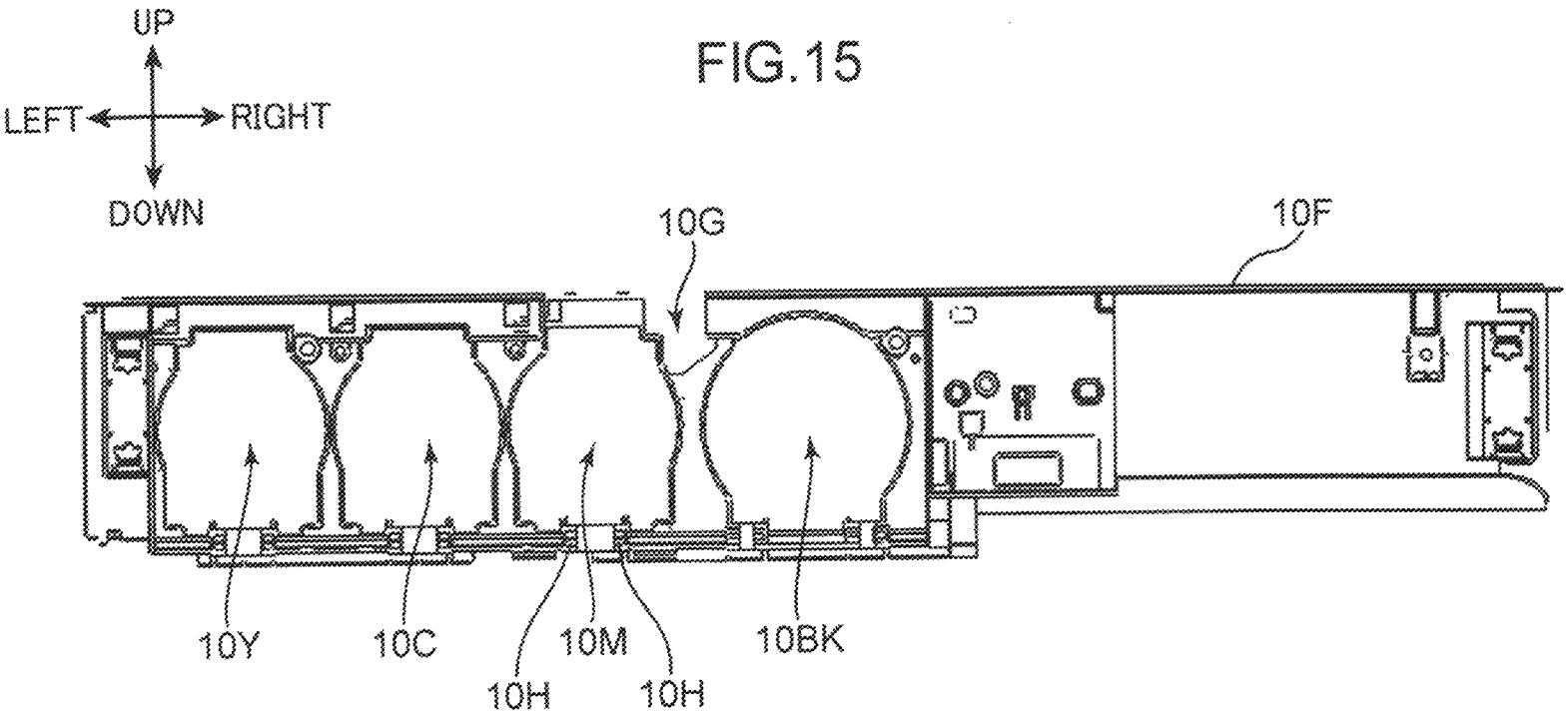
FIG. 15 is a front view of the front frame of the image forming apparatus according to the one embodiment of the present disclosure.
Figure 16A:
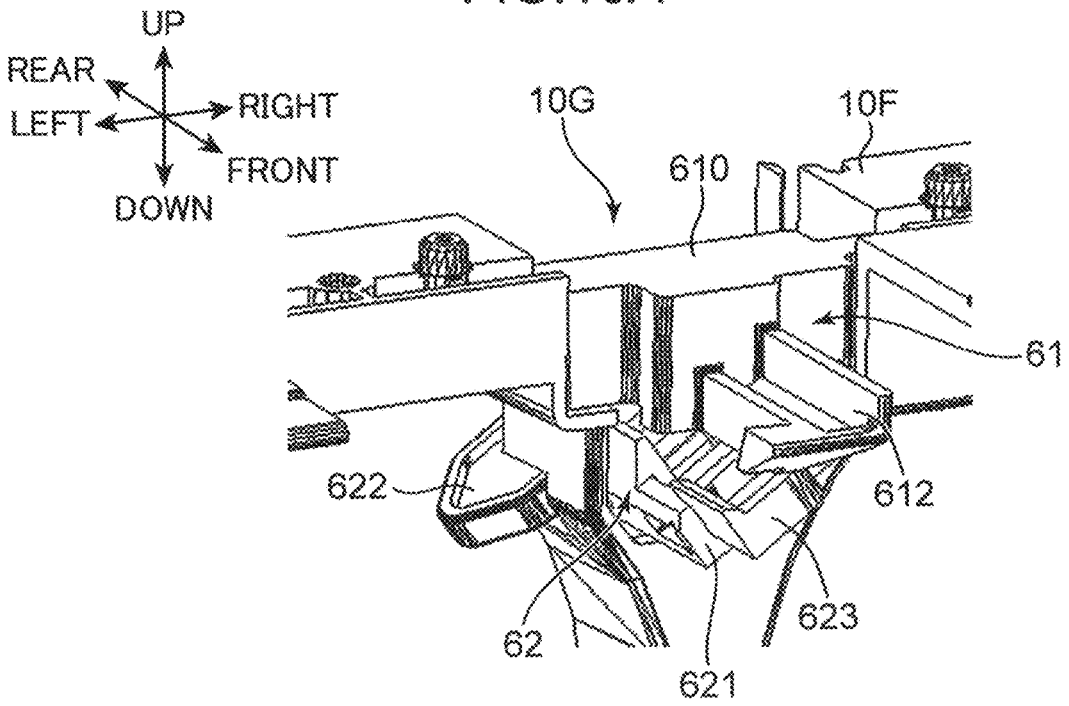
FIG. 16A is a perspective view showing a state where the body lock portion and the lock restricting portion are mounted on the front frame of the image forming apparatus according to the one embodiment of the present disclosure.
Figure 16B:
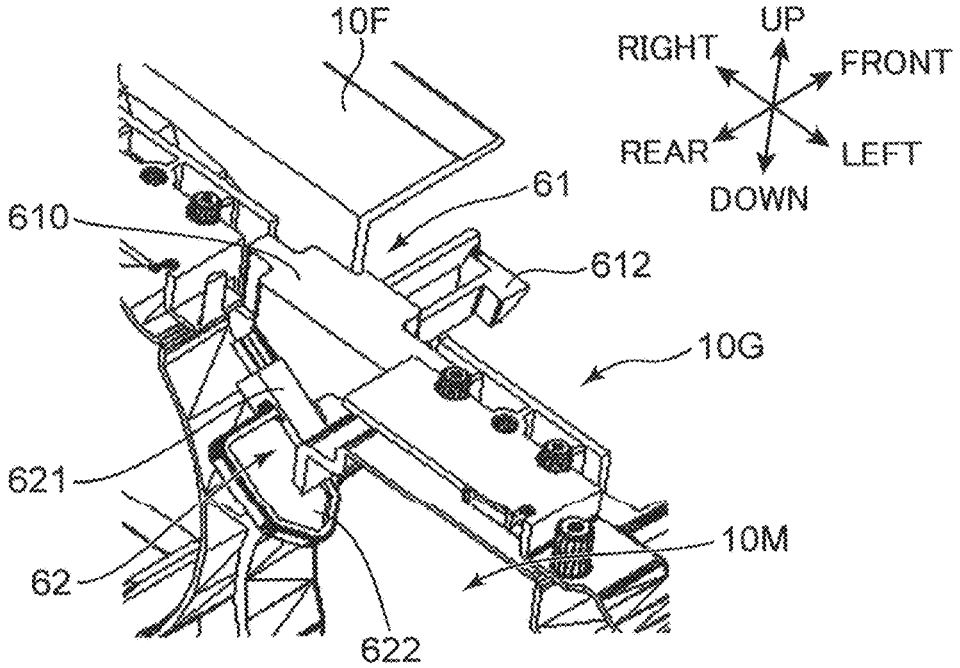
FIG. 16B is an enlarged perspective view showing the state where the body lock portion and the lock restricting portion are mounted on the front frame of the image forming apparatus according to the one embodiment of the present disclosure.

FIG. 15 is a front view of the front frame 10F of the image forming apparatus 1 according to this embodiment. FIGS. 16A and 16B are a perspective view and an enlarged perspective view showing a state where the body lock portion 61 and the lock restricting portion 62 are mounted on the front frame 10F of the image forming apparatus 1 according to this embodiment.

With reference to FIG. 15, the front frame 10F is formed with a lock attaching portion 10G above the magenta attaching portion 10M into which the toner container 50 of magenta is inserted. Note that although the lock attaching portion 10G is shown only above the magenta attaching portion 10M in FIG. 15, similar lock attaching portions 10G are formed also above the yellow, cyan and black attaching portions 10Y, 10C and 10Bk.

With reference to FIGS. 16A and 16B, the body lock portion 61 is mounted and fixed to the lock attaching portion 10G with the lock restricting portion 62 slidably mounted on the guide portions 611 of the body lock portion 61 (FIGS. 12A to 12C). As a result, as shown in FIG. 16B, the third pressed portion 622 of the lock restricting portion 62 is arranged to enter the magenta attaching portion 10M on a rear side of the front frame 10F. Further, the projection 612 of the body lock portion 61 is arranged to project on a front side of the front frame 10F. Note that the same applies also to the body lock portions 61 and the lock restricting portions 62 of the other colors.

<Concerning Closing Operation of Container Cover>

Figure 17A:
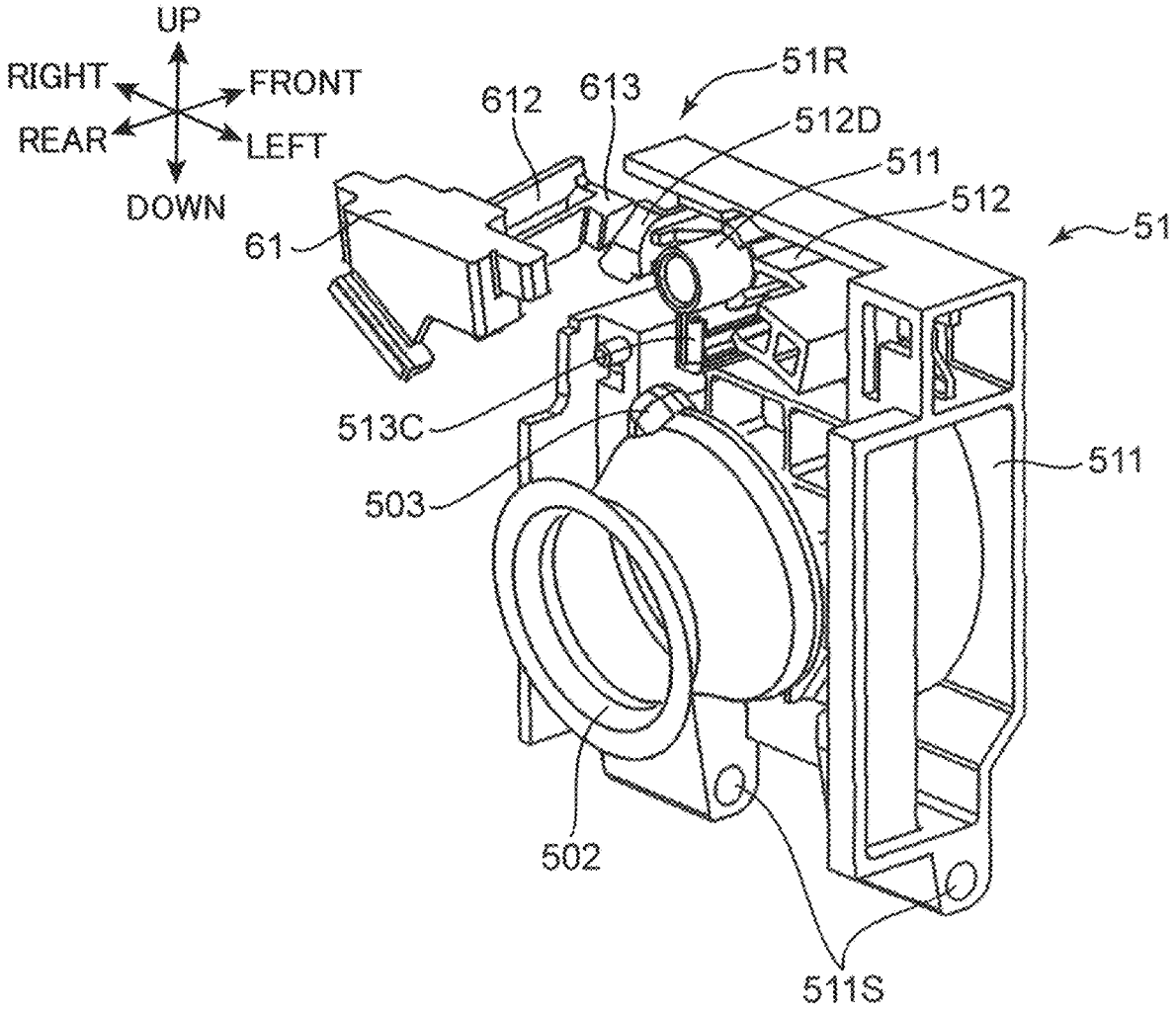
FIG. 17A is a perspective view showing a state where the container cover of the image forming apparatus according to the one embodiment of the present disclosure is being closed.
Figure 17B:
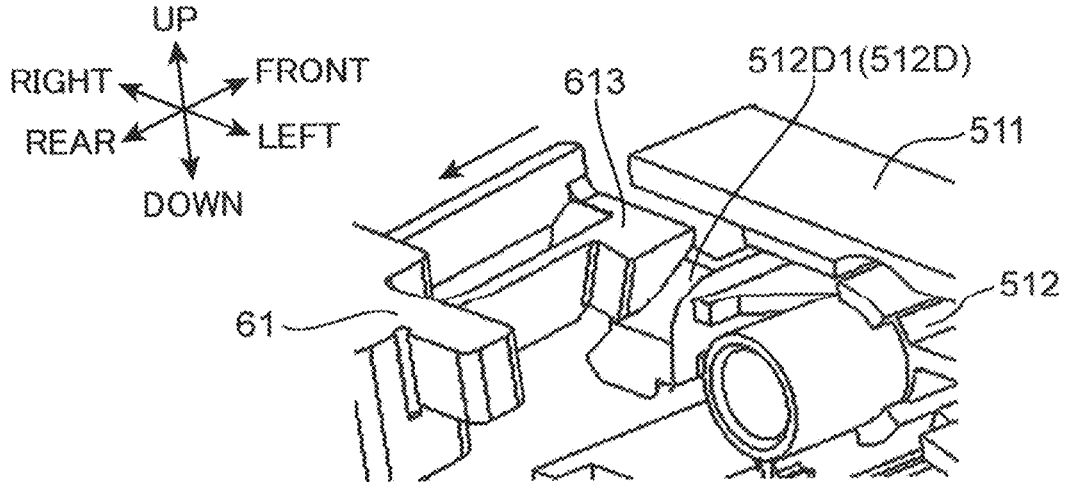
FIG. 17B is an enlarged perspective view showing the state where the container cover of the image forming apparatus according to the one embodiment of the present disclosure is being closed.
Figure 17C:
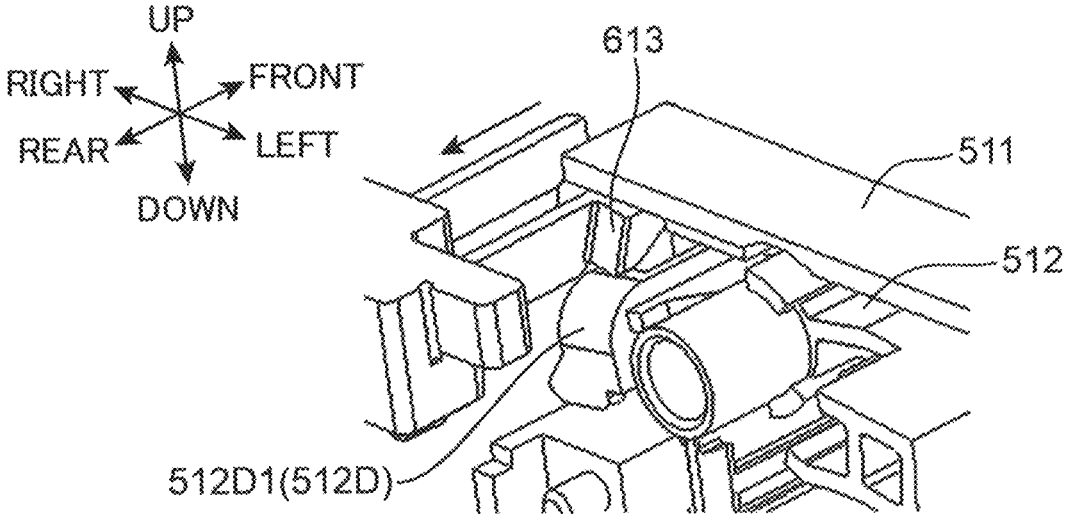
FIG. 17C is an enlarged perspective view showing the state where the container cover of the image forming apparatus according to the one embodiment of the present disclosure is being closed.
Figure 17D:
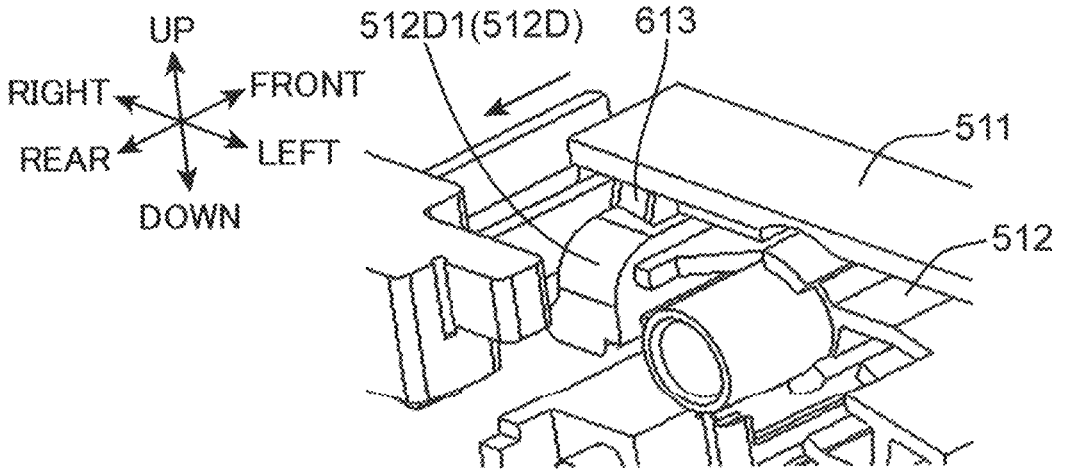
FIG. 17D is an enlarged perspective view showing the state where the container cover of the image forming apparatus according to the one embodiment of the present disclosure is being closed.

FIG. 17A is a perspective view showing a state where the container cover 51 of the image forming apparatus 1 according to this embodiment is being closed. FIGS. 17B, 17C and 17D are enlarged perspective views showing the state where the container cover 51 is being closed. FIGS. 18A, 18B, 18C and 18D are side sectional views showing the state where the container cover 51 is being closed. Note that FIGS. 18A to 18D respectively show the same states as FIGS. 17A to 17D.

Figure 18A:
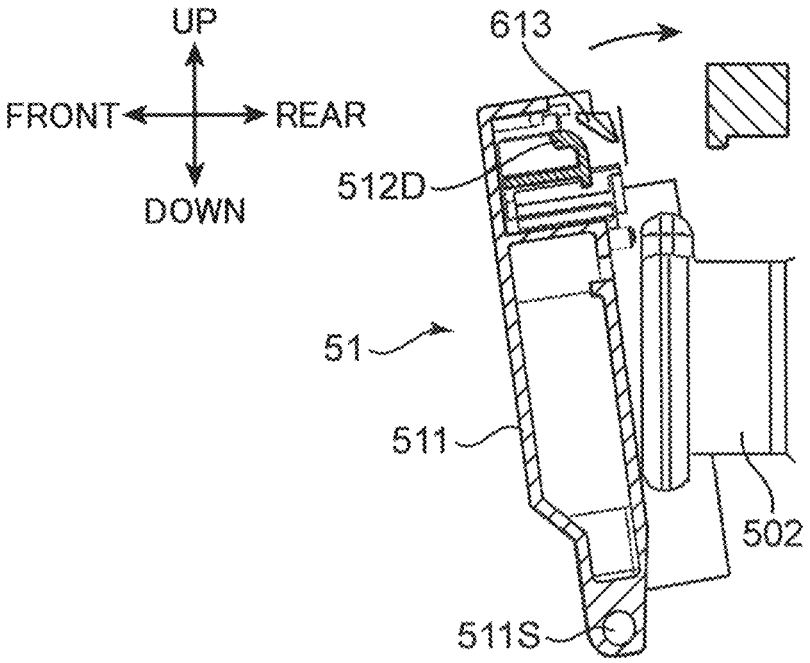
FIG. 18A is a side sectional view showing the state where the container cover of the image forming apparatus according to the one embodiment of the present disclosure is being closed.
Figure 18B:
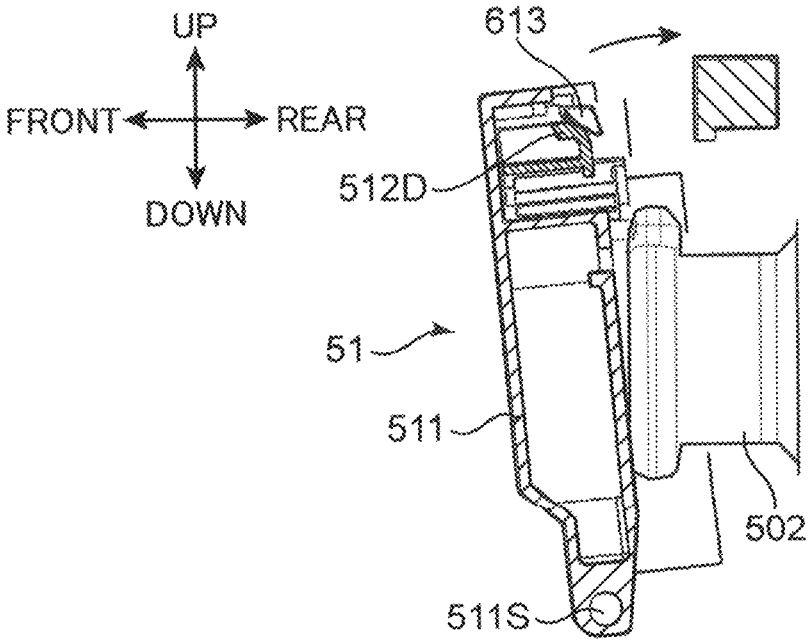
FIG. 18B is a side sectional view showing the state where the container cover of the image forming apparatus according to the one embodiment of the present disclosure is being closed.
Figure 18C:
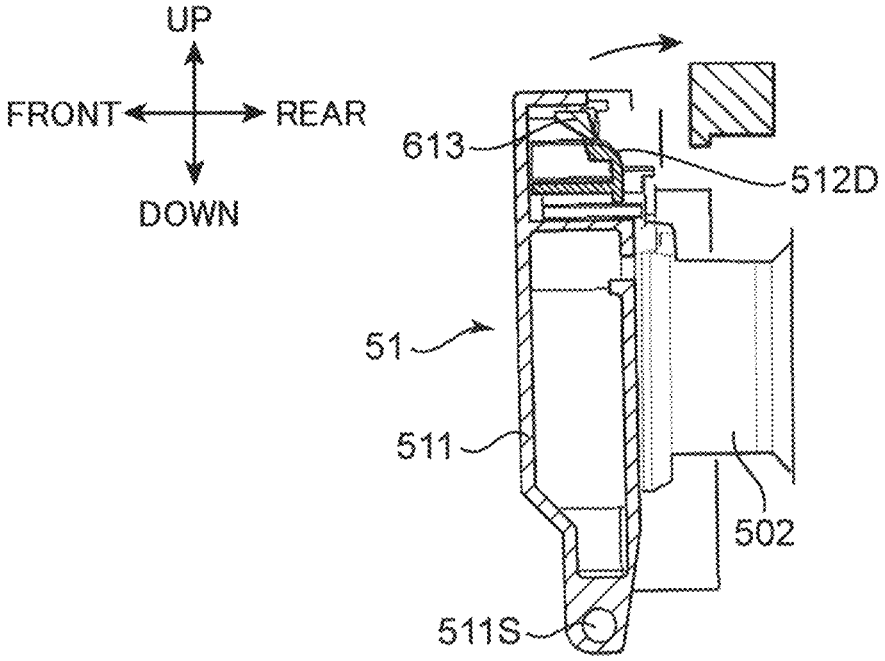
FIG. 18C is a side sectional view showing the state where the container cover of the image forming apparatus according to the one embodiment of the present disclosure is being closed.
Figure 18D:
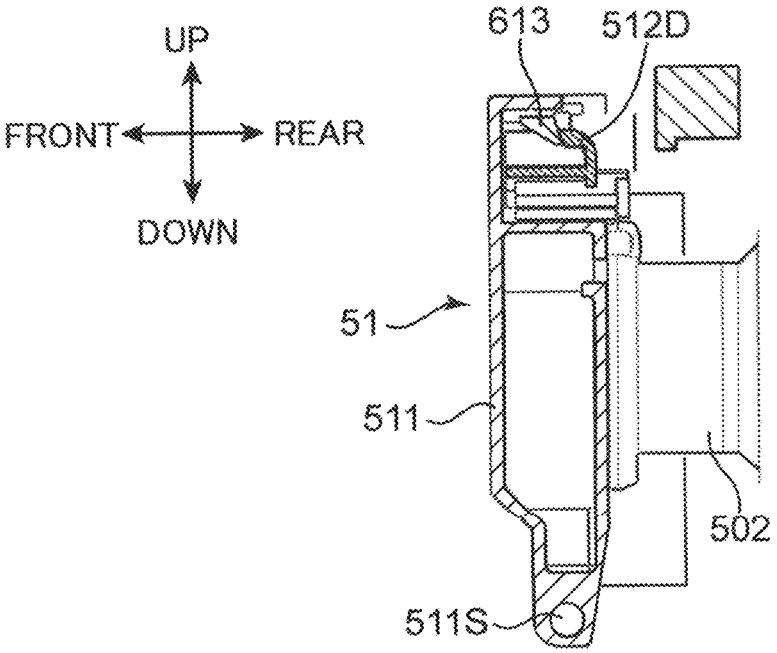
FIG. 18D is a side sectional view showing the state where the container cover of the image forming apparatus according to the one embodiment of the present disclosure is being closed.

If the container cover 51 is opened with respect to the front frame 10F with the front cover 10A opened with respect to the apparatus body 10, the container cover 51 can be detached and attached (exchanged). When an operator (user) closes the container cover 51 thereafter, the container cover 51 rotates rearward about the cover supporting point portions 511S (FIGS. 17A, 18A). At this time, the lever lock portion 512D moves rearward to slip under the engaging portion 613 while the inclined portion 512D1 (FIG. 10A) of the lever lock portion 512D of the first lever 512 rubs against the sliding slopes 613A (FIGS. 12A to 12C) of the engaging portion 613 of the body lock portion 61 (FIGS. 17B, 17C, 18B, 18C). At this time, the first lever 512 pivots about the shaft portion 511T so that the first arm 512B moves downward. Eventually, when the lever lock portion 512D reaches a position behind the engaging portion 613, the first lever 512 pivots about the shaft portion 511T so that the first arm 512B moves upward. As a result, a lock engaging surface 512D2 (FIG. 10B) of the lever lock portion 512D comes into contact with the engaged surface 613B (FIG. 12C) of the engaging portion 613 and the container cover 51 is locked in the closed state by the engaging portion 613 (body lock portion 61) (FIGS. 17D, 18D).

<Concerning State of Lock Mechanism During Toner Replenishment>

Figure 19A:
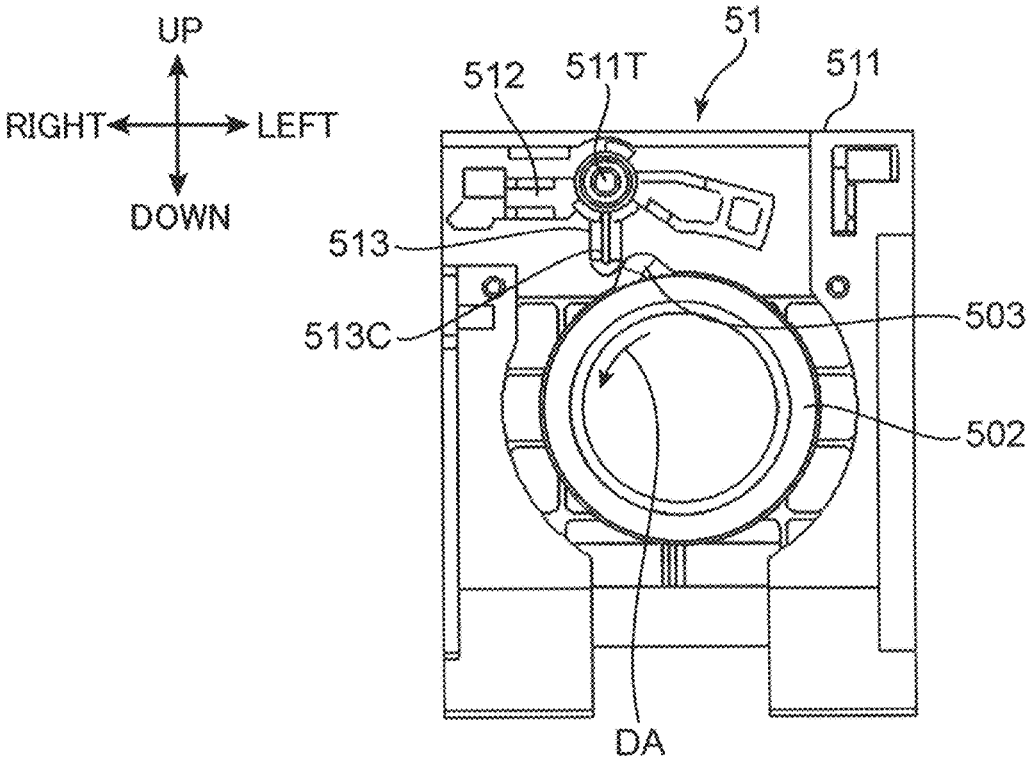
FIG. 19A is a back view showing a state where the container body of the toner container of the image forming apparatus according to the one embodiment of the present disclosure is being rotated in a first rotating direction.
Figure 19B:
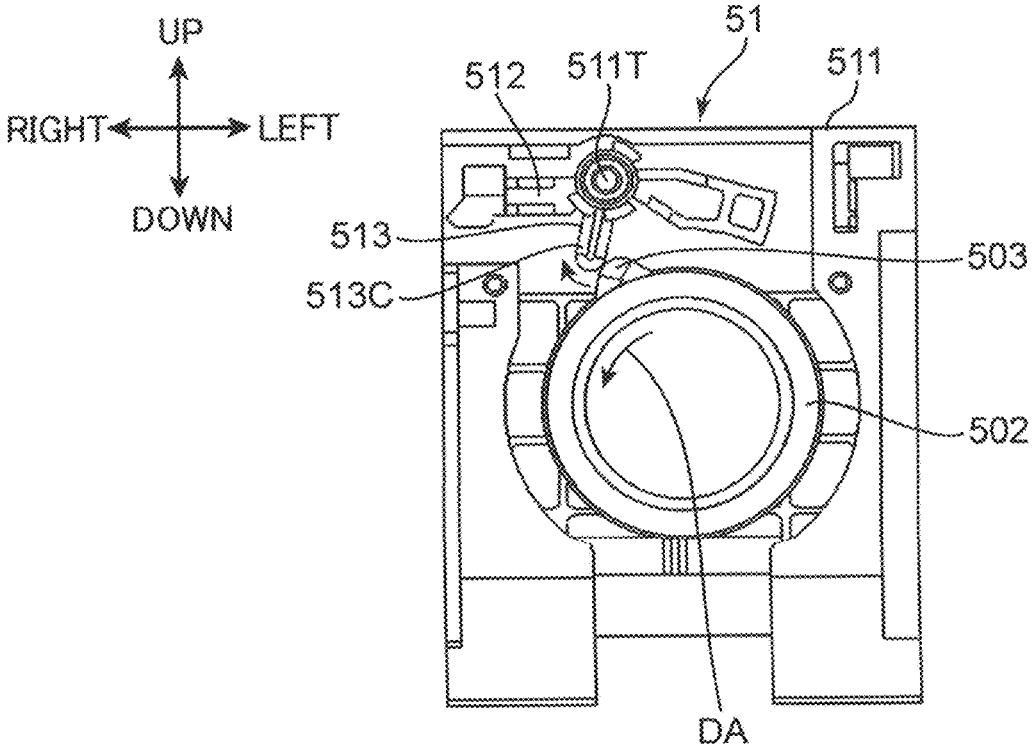
FIG. 19B is a back view showing the state where the container body of the toner container of the image forming apparatus according to the one embodiment of the present disclosure is being rotated in the first rotating direction.
Figure 19C:
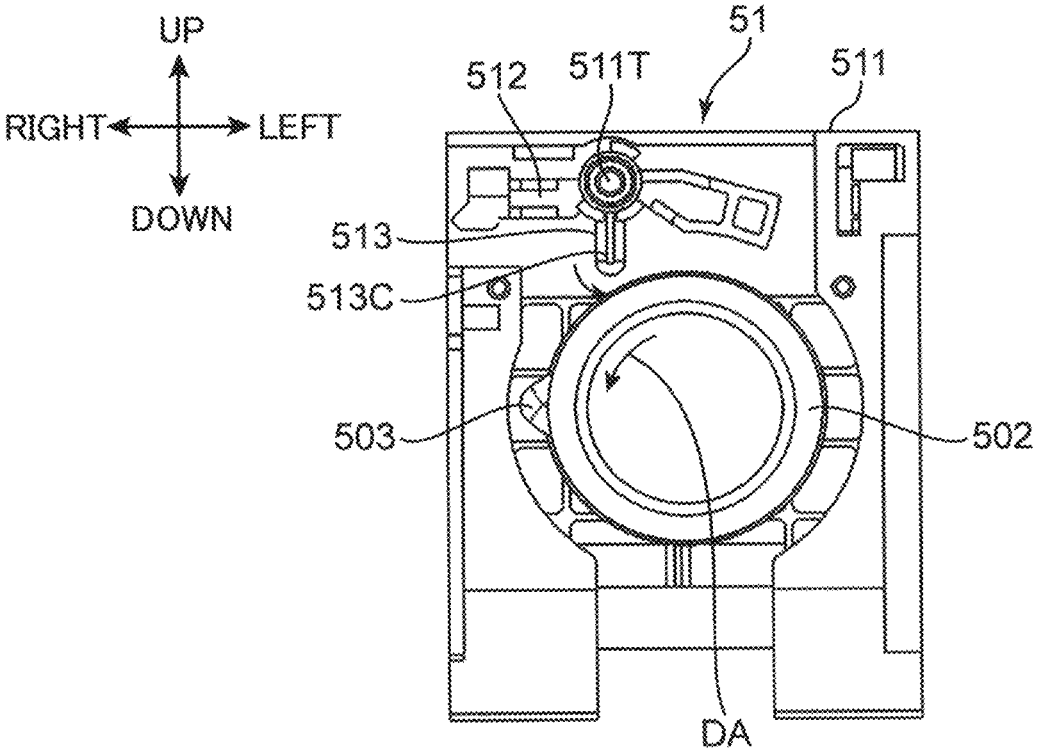
FIG. 19C is a back view showing the state where the container body of the toner container of the image forming apparatus according to the one embodiment of the present disclosure is being rotated in the first rotating direction.

FIGS. 19A to 19C are back views successively showing a state where the container body 500 of the toner container 50 of the image forming apparatus 1 according to this embodiment is being rotated in the first rotating direction. As described above, in replenishing the toner from the toner container 50 to the developing device 23, an unillustrated controller inputs a command signal to the motor 520 of the container driver 52 and the container body 500 of the toner container 50 is rotated in the first rotating direction DA. At this time, as shown in FIG. 19A, the projection 503 projecting on the grip portion 502 of the container body 500 comes into contact with the second pressed portion 513C of the second lever 513 from left. As a result, as shown in FIG. 19B, the second pressed portion 513C is pressed rightward by the projection 503 and the second lever 513 pivots clockwise (third rotating direction) about the shaft portion 511T. At this time, since the second lever 513 does not contact the first arm 512B of the first lever 512, the first lever 512 does not pivot about the shaft portion 511T. Thus, the locking state where the lever lock portion 512D of the first lever 512 is engaged with the second lever 513 is maintained. Eventually, when the projection 503 passes over the second pressed portion 513C as shown in FIG. 19C, the second lever 513 pivots counterclockwise (fourth rotating direction) about the shaft portion 511T by its own weight and returns to the same standby posture as in FIG. 19A.

As just described, in this embodiment, if the container body 500 is rotated in the first rotating direction DA by the container driver 52 and the projection 503 comes into contact with the second pressed portion 513C, the second lever 513 relatively pivots in the third rotating direction about the shaft portion 511T (rotation center axis) with respect to the first lever 512 so that the lever lock portion 512D of the first lever 512 continues to be engaged with the engaging portion 613, whereby the lock mechanism 51R maintains the locking state.

<Concerning Unlocking of Lock Mechanism>

Figure 20A:
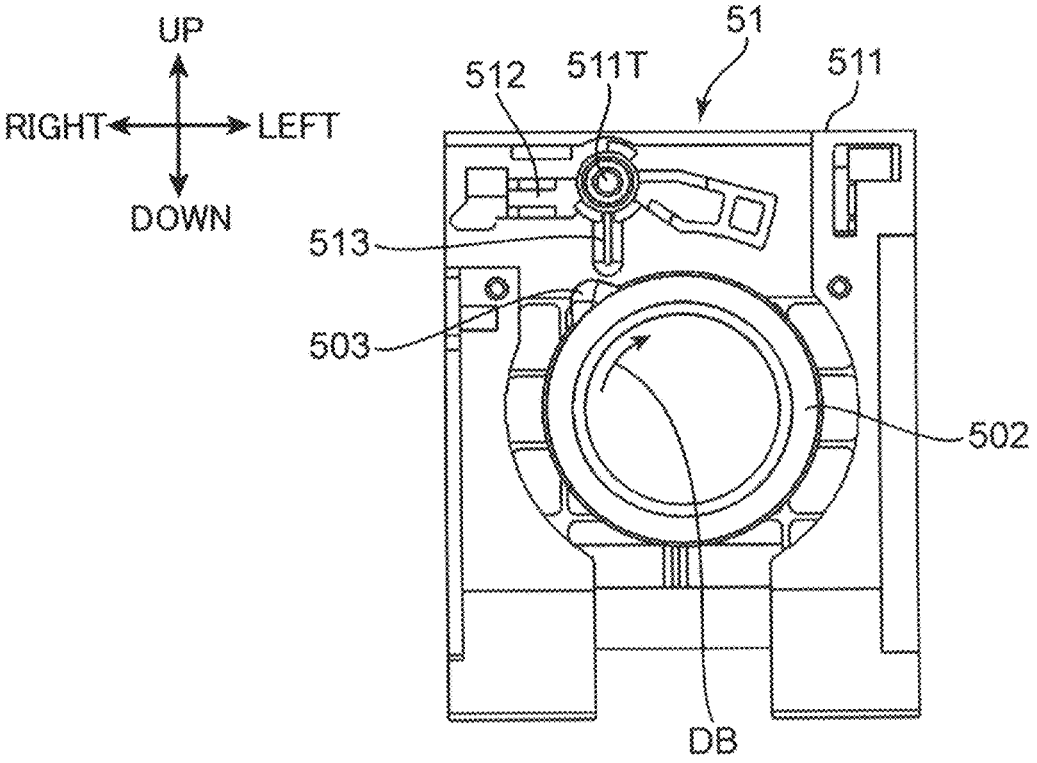
FIG. 20A is a back view showing a state where the container body of the toner container of the image forming apparatus according to the one embodiment of the present disclosure is being rotated in a second rotating direction.
Figure 20B:
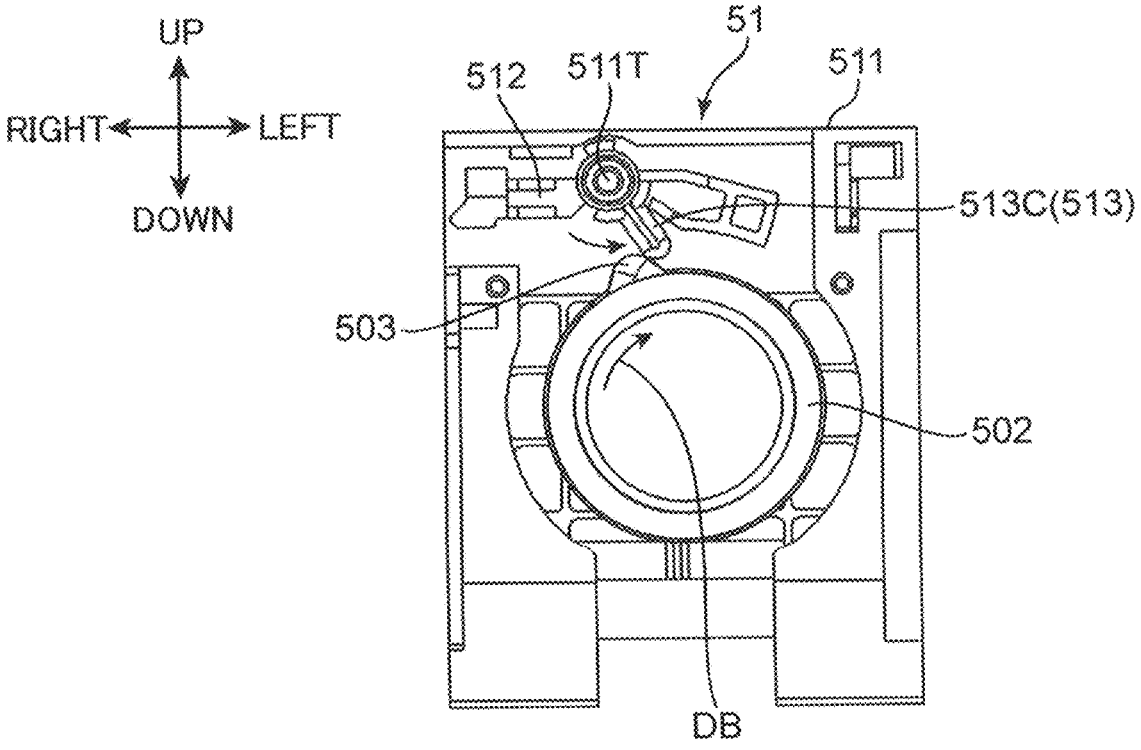
FIG. 20B is a back view showing the state where the container body of the toner container of the image forming apparatus according to the one embodiment of the present disclosure is being rotated in the second rotating direction.
Figure 20C:
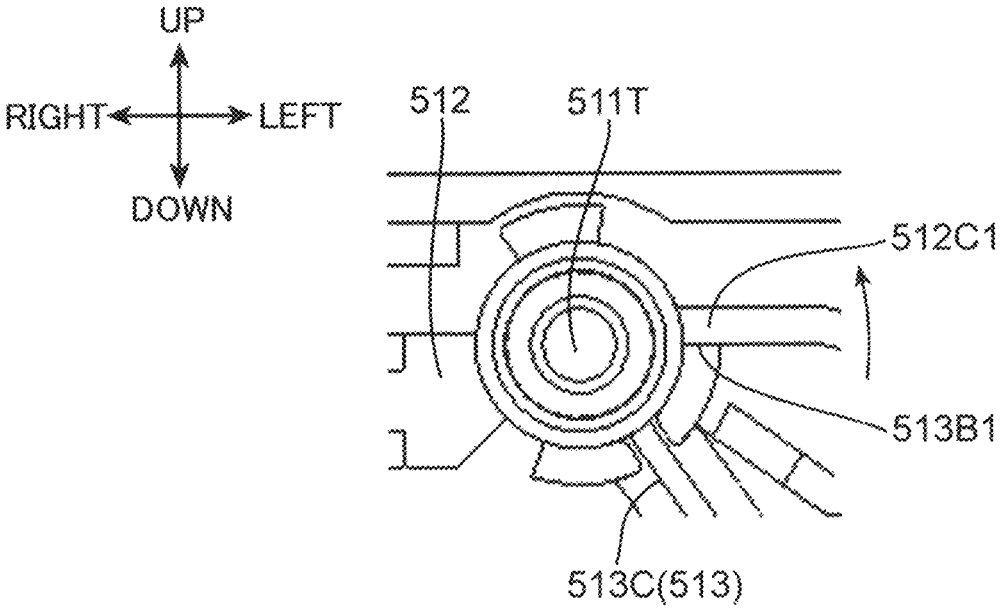
FIG. 20C is an enlarged back view showing the state where the container body of the toner container of the image forming apparatus according to the one embodiment of the present disclosure is being rotated in the second rotating direction.
Figure 20D:
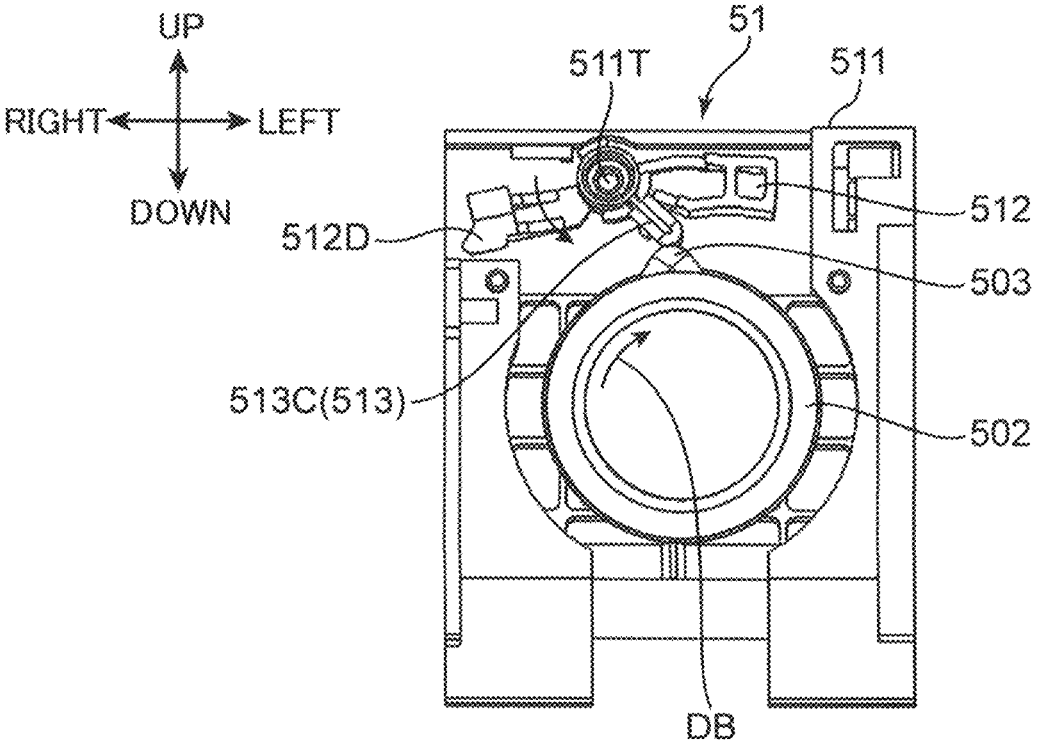
FIG. 20D is a back view showing the state where the container body of the toner container of the image forming apparatus according to the one embodiment of the present disclosure is being rotated in the second rotating direction.
Figure 21A:
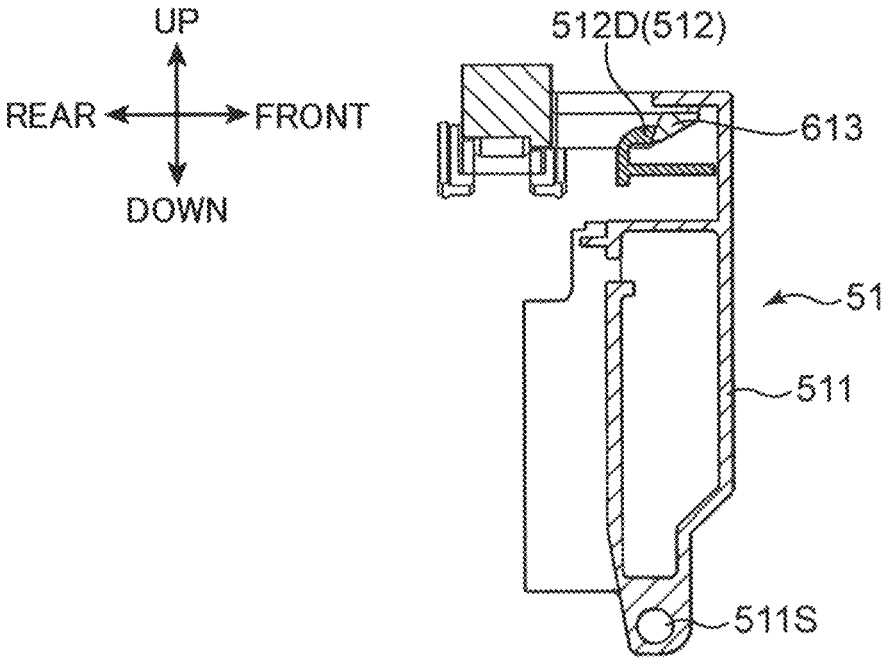
FIG. 21A is a side sectional view showing a state where the container cover of the image forming apparatus according to the one embodiment of the present disclosure is being opened.
Figure 21B:
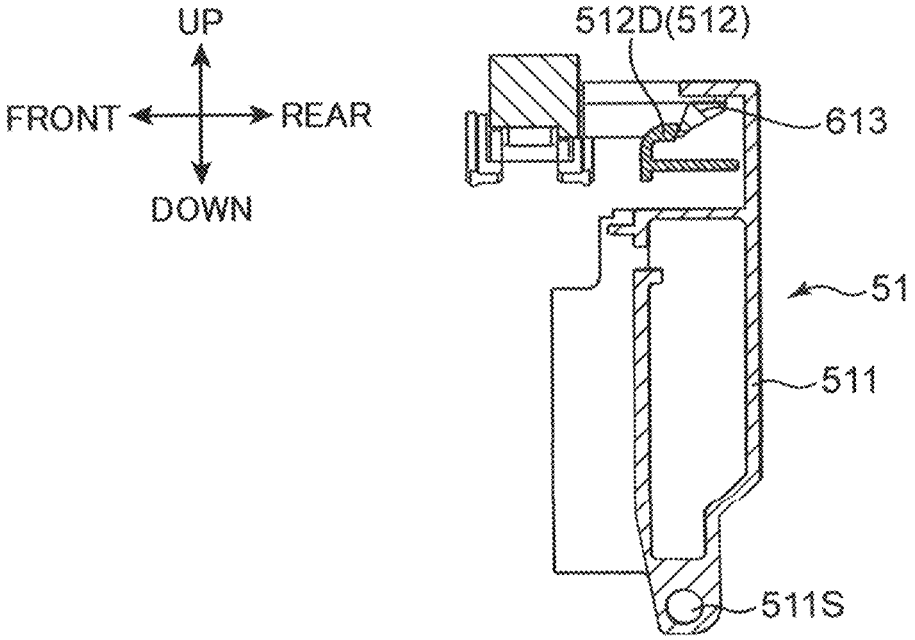
FIG. 21B is a side sectional view showing the state where the container cover of the image forming apparatus according to the one embodiment of the present disclosure is being opened.
Figure 21C:
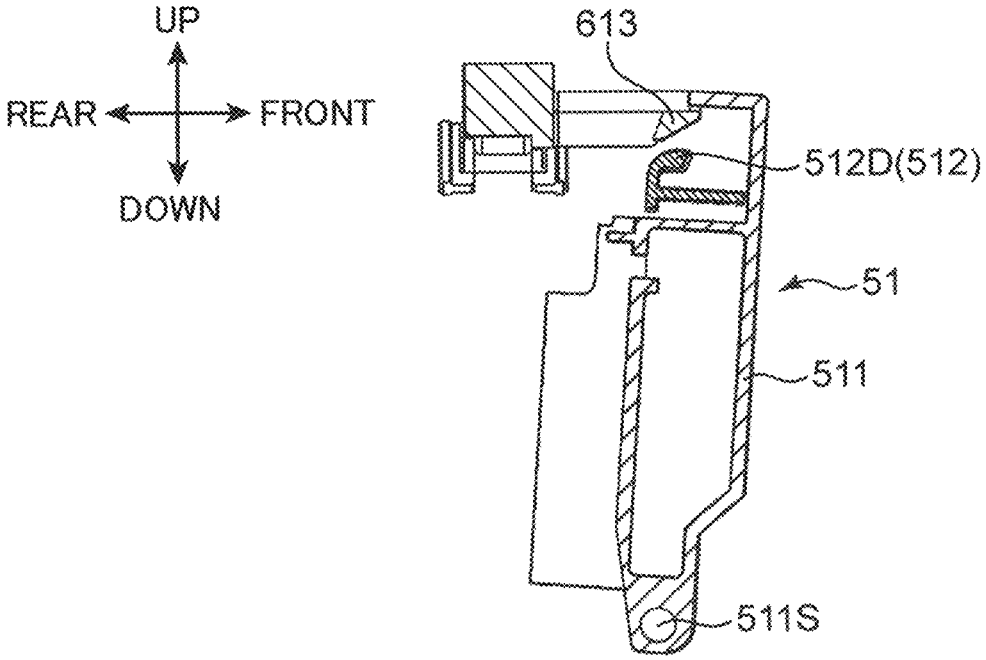
FIG. 21C is a side sectional view showing the state where the container cover of the image forming apparatus according to the one embodiment of the present disclosure is being opened.

FIGS. 20A, 20B and 20D are back views showing a state where the container body 500 of the toner container 50 of the image forming apparatus 1 according to this embodiment is being rotated in the second rotating direction. FIG. 20C is an enlarged back view enlargedly showing a part of FIG. 20B. FIGS. 21A, 21B and 21C are side sectional views showing a state where the container cover 51 of the image forming apparatus 1 according to this embodiment is being opened.

If it is detected by an unillustrated toner sensor that the toner in the toner container 50 has run out (empty state), the controller causes a display panel of the image forming apparatus 1 to display a message to exchange the toner container 50. Further, the controller performs an unlocking operation of the container cover 51 by rotating the container body 500 of the toner container 50 in the second rotating direction DB. At this time, as shown in FIG. 20A, the projection 503 provided on the grip portion 502 of the container body 500 presses the second pressed portion 513C of the second lever 513 leftward. As a result, the second lever 513 pivots about the shaft portion 511T (FIG. 20B). Thereafter, the pressing portion 513B1 of the second lever 513 pushes up the first pressed portion 512C1 of the first lever 512 as shown in FIG. 20C, whereby the first lever 512 pivots about the shaft portion 511T so that the first arm 512B moves downward (FIG. 20D). As just described, as the first arm 512B of the first lever 512 moves downward, the lever lock portion 512D of the first lever 512 moves downward from the engaging portion 613 as shown in FIGS. 21A to 21C, whereby the lever lock portion 512D and the engaging portion 613 are disengaged. Specifically, the locking state of the container cover 51 by the lock mechanism 51R is released. As a result, the container cover 51 can rotate forward about the cover supporting point portions 511S.

Figure 22:
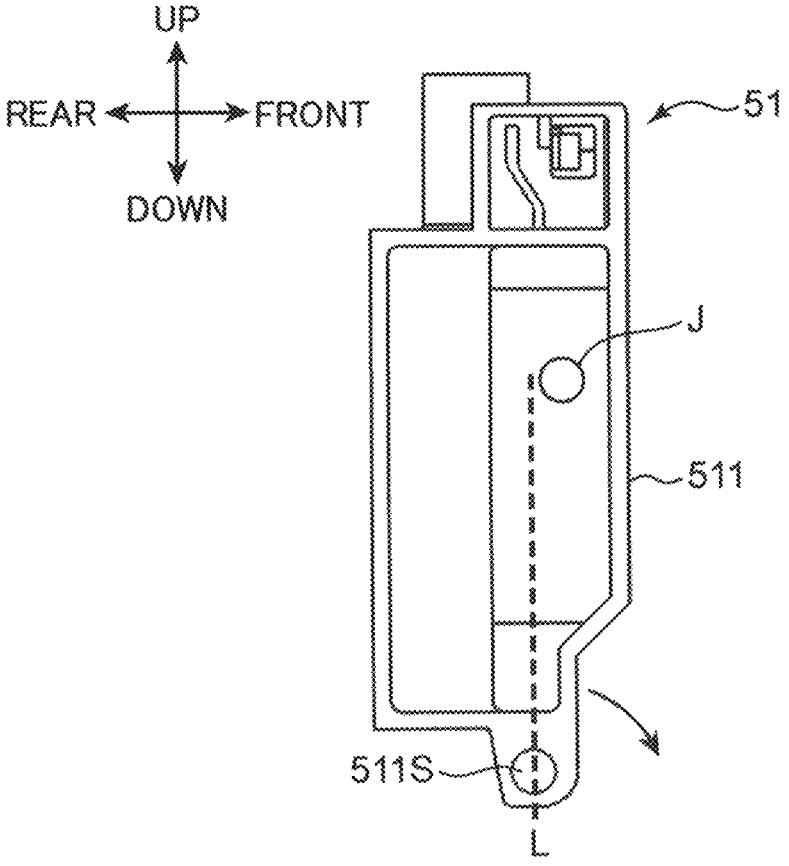
FIG. 22 is a side sectional view showing a center-of-gravity position of the container cover of the image forming apparatus according to the one embodiment of the present disclosure.

FIG. 22 is a side sectional view showing a center-of-gravity position of the container cover 51 of the image forming apparatus 1 according to this embodiment. As shown in FIG. 22, a center of gravity J of the container cover 51 is located forward of the cover supporting point portions 511S in this embodiment. Thus, if the locking of the container cover 51 by the lock mechanism 51R is released, the container cover 51 can rotate forward by its own weight (due to its center-of-gravity position).

Note that if the front cover 10A is closed with respect to the apparatus body 10 when the container cover 51 is unlocked, an upper end part of the container cover 51 is in contact with the front cover 10A after the container cover 51 slightly rotates about the cover supporting point portions 511S. If the user of the image forming apparatus 1 opens the front cover 10A thereafter, the container cover 51 rotates forward together with the front cover 10A and the toner container 50 attached to the magenta attaching portion 10M is exposed to the outside of the apparatus body 10. Further, if the front cover 10A is opened with respect to the apparatus body 10 in advance when the container cover 51 is unlocked, the container cover 51 rotates about the cover supporting point portions 511S and the toner container 50 attached to the magenta attaching portion 10M is exposed to the outside of the apparatus body 10.

As just described, in this embodiment, if the container body 500 of the toner container 50 is rotated in the second rotating direction DB by the container driver 52 and the projection 503 comes into contact with the second pressed portion 513C of the second lever 513, the second lever 513 pivots in the fourth rotating direction opposite to the third rotating direction about the shaft portion 511T integrally with the first lever 512, whereby the lever lock portion 512D of the first lever 512 is disengaged from the engaging portion 613 and the state of the lock mechanism 51R is switched from the locking state to the unlocking state.

As described above, in this embodiment, the toner is discharged from the toner container 50 toward the developing device 23 if the container body 500 of the toner container 50 is rotated in the first rotating direction DA by the container driver 52, whereas the toner is held in the toner container 50 if the container body 500 of the toner container 50 is rotated in the second rotating direction DB by the container driver 52. On the other hand, the container cover 51 openably and closably supported on the apparatus body 10 allows the toner container 50 to be attached to and detached from the apparatus body 10. If the lock mechanism 51R is set in the locking state, the container cover 51 is locked in the closed state. Thus, it is prevented that the toner container 50 is erroneously exchanged. On the other hand, if the lock mechanism 51R is set in the unlocking state, the state of the container cover 51 is changed from the closed state to the open state to enable an exchange of the toner container 50. The state of the lock mechanism 51R can be switched from the locking state to the unlocking state by receiving a rotational drive force of the container driver 52 for rotating the container body 500 of the toner container 50. Thus, the lock mechanism 51R can lock the container cover 51 in the closed state and release the locked state without having a dedicated drive source.

Further, in this embodiment, the state of the lock mechanism 51R can be switched between the locking state and the unlocking state by relative or integral pivoting movements of the first and second levers 512, 513. Further, the second lever 513 can be pivoted, utilizing the container body 500 rotated by the container driver 52.

Furthermore, in this embodiment, the rotation center axis of the first lever 512 and that of the second lever 513 are arranged on the same axis (shaft portion 511T). Thus, the first and second levers 512, 513 pivot about the rotation center axes arranged on the same axis, wherefore the lock mechanism 51R can be arranged, efficiently utilizing a part (lever housing portion 511A) of the container cover 51.

Further, in this embodiment, the second lever 513 includes the pressing portion 513B1. The pressing portion 513B1 can press the first pressed portion 512C1 of the first lever 512 from below to pivot the first lever 512 in the fourth rotating direction integrally with the second lever 513. Thus, the second lever 513 can be pivoted and the rotational drive force can be reliably transmitted from the second lever 513 to the first lever 512, utilizing the container body 500 rotated by the container driver 52.

Furthermore, in this embodiment, if the state of the lock mechanism 51R is switched from the locking state to the unlocking state, the container cover 51 can be easily opened by its own weight. Thus, the cost of the container cover 51 can be reduced as compared to the case where spring members or the like for opening the container cover 51 are arranged on the cover supporting point portions 522S of the container cover 51. Note that spring members as described above may be arranged in another embodiment.

<Concerning Lock Restricting Mechanism>

Figure 23:
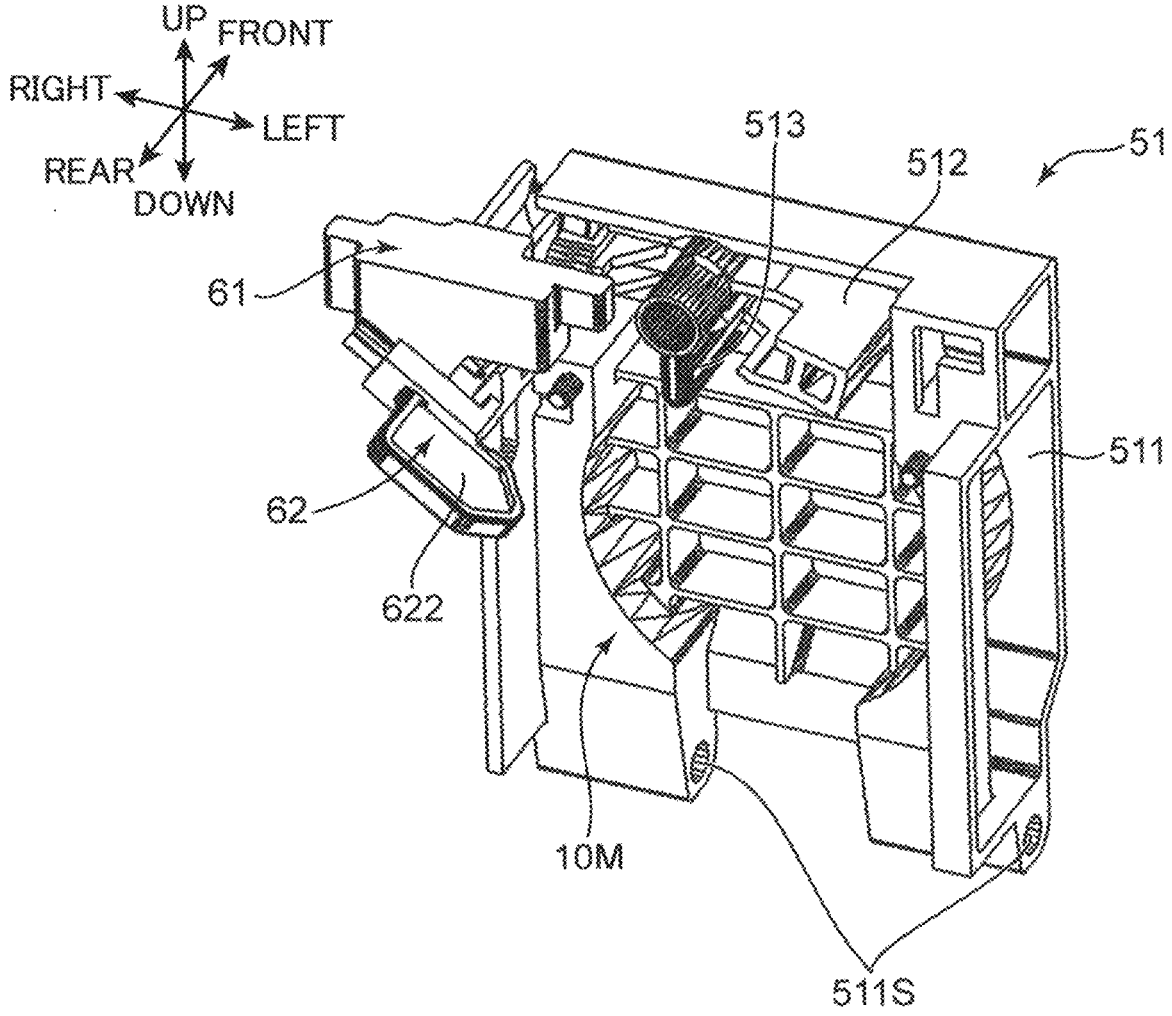
FIG. 23 is a perspective view showing the container cover and the lock restricting portion of the image forming apparatus according to the one embodiment of the present disclosure.
Figure 24A:
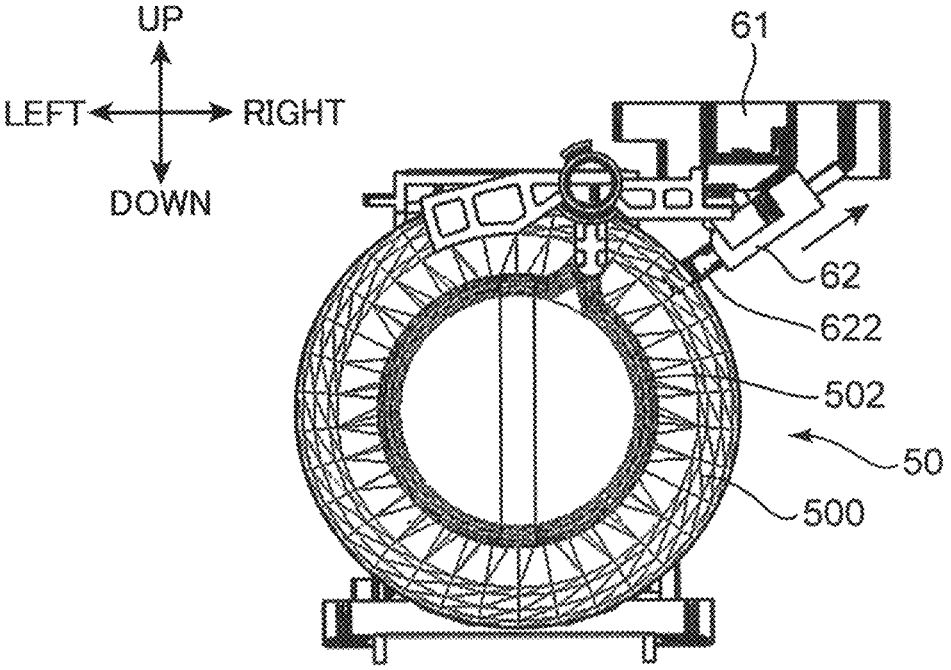
FIG. 24A is a front view showing the lock restricting portion of the image forming apparatus according to the one embodiment of the present disclosure.
Figure 24B:
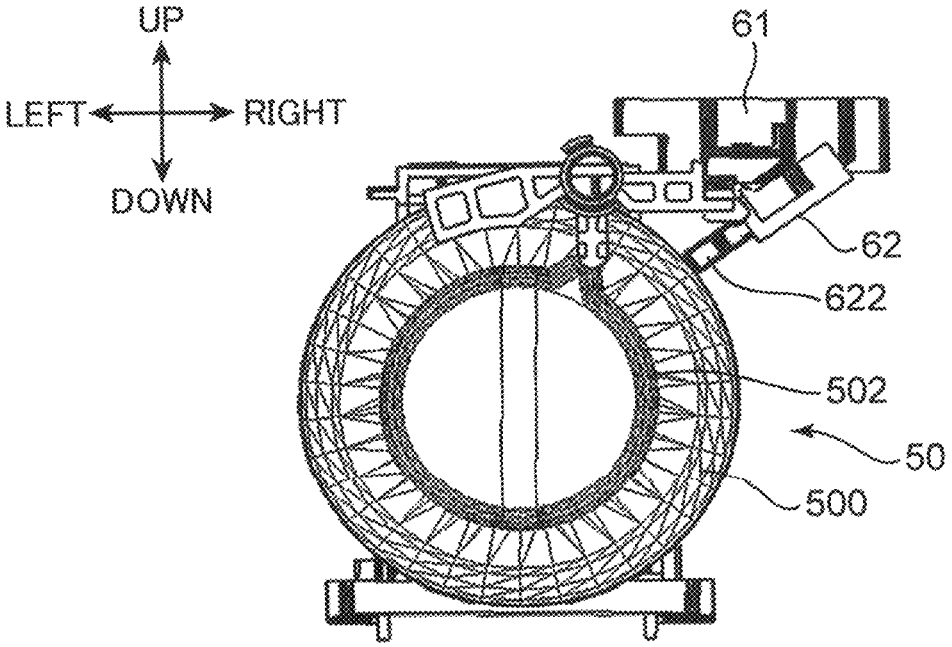
FIG. 24B is a front view showing the lock restricting portion of the image forming apparatus according to the one embodiment of the present disclosure.
Figure 25A:
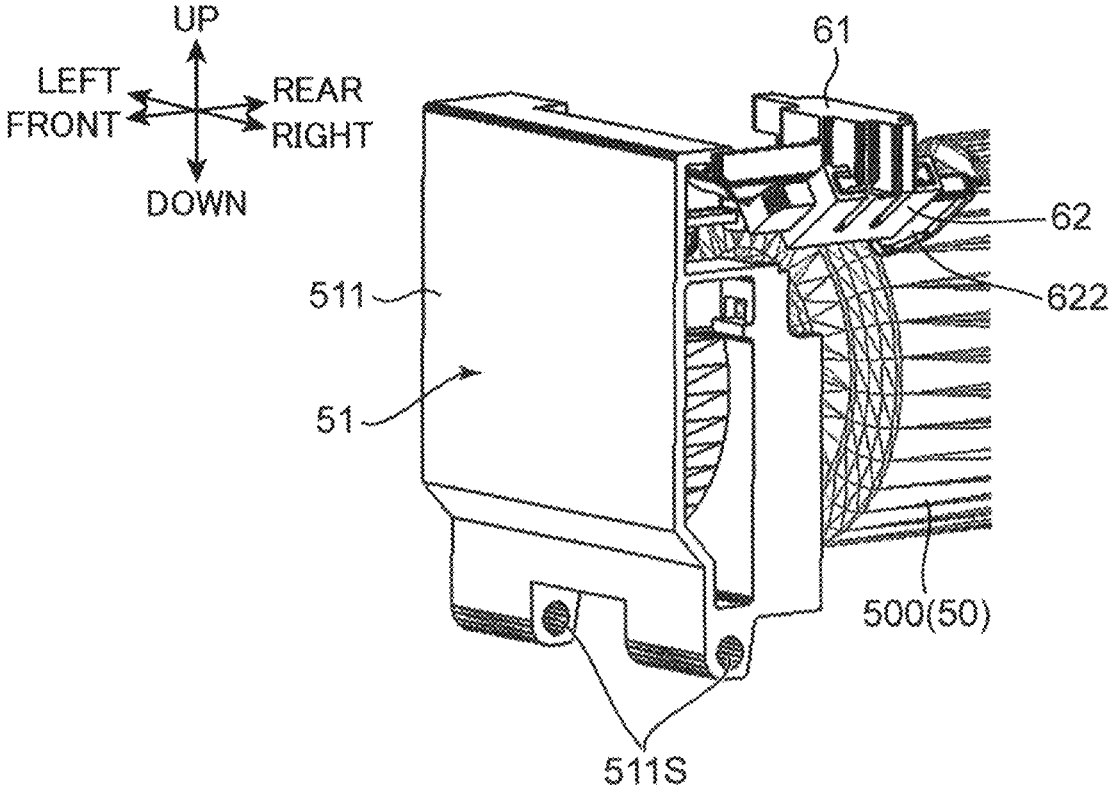
FIG. 25A is a perspective view showing the lock restricting portion in a state where the toner container is attached to an apparatus body of the image forming apparatus according to the one embodiment of the present disclosure.
Figure 25B:
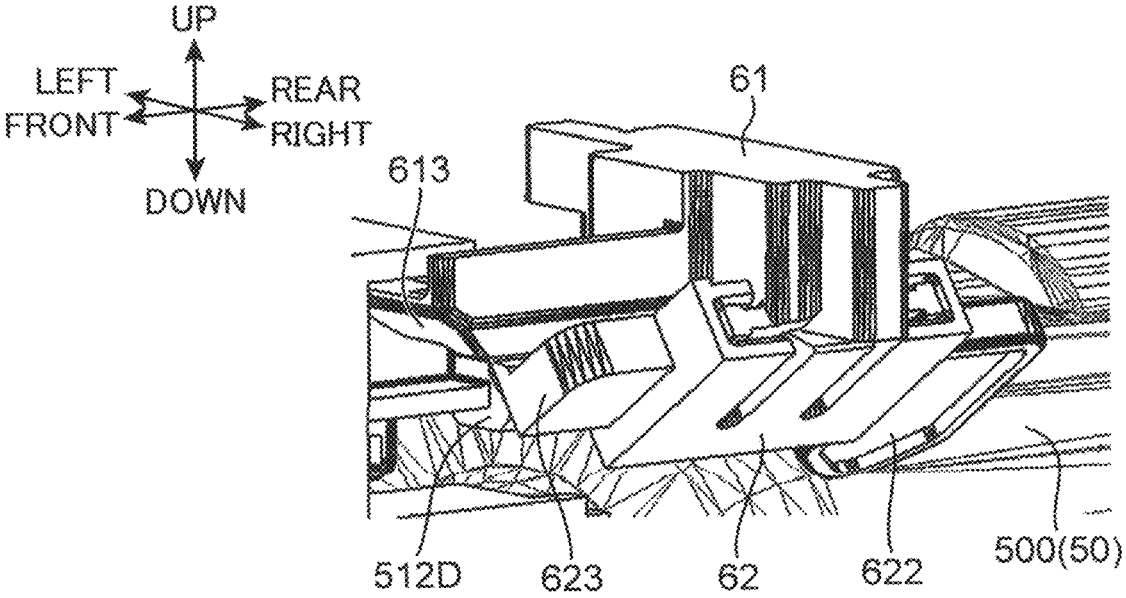
FIG. 25B is an enlarged perspective view showing the lock restricting portion in the state where the toner container is attached to the apparatus body of the image forming apparatus according to the one embodiment of the present disclosure.
Figure 26A:
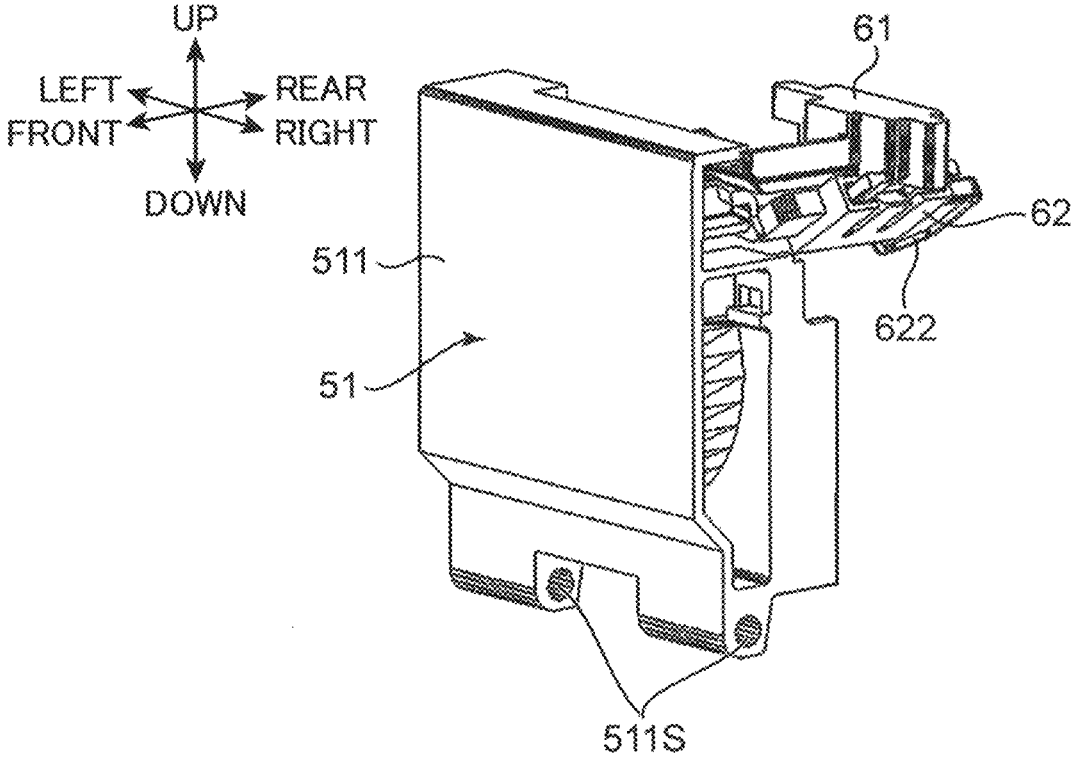
FIG. 26A is a perspective view showing the lock restricting portion in a state where the toner container is not attached to the apparatus body of the image forming apparatus according to the one embodiment of the present disclosure.
Figure 26B:
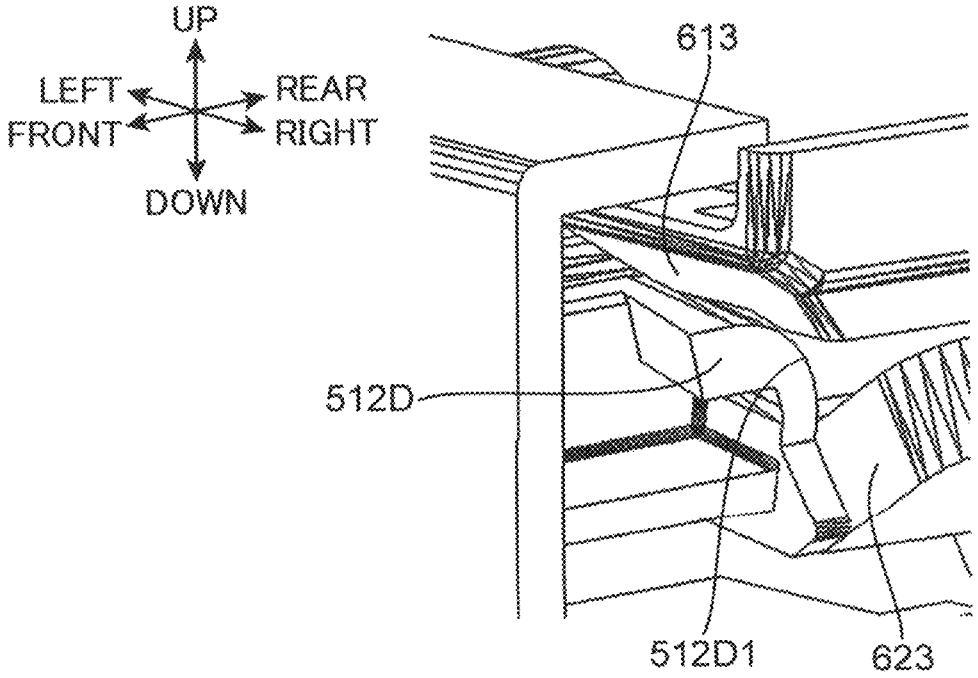
FIG. 26B is an enlarged perspective view showing the lock restricting portion in the state where the toner container is not attached to the apparatus body of the image forming apparatus according to the one embodiment of the present disclosure.
Figure 27:
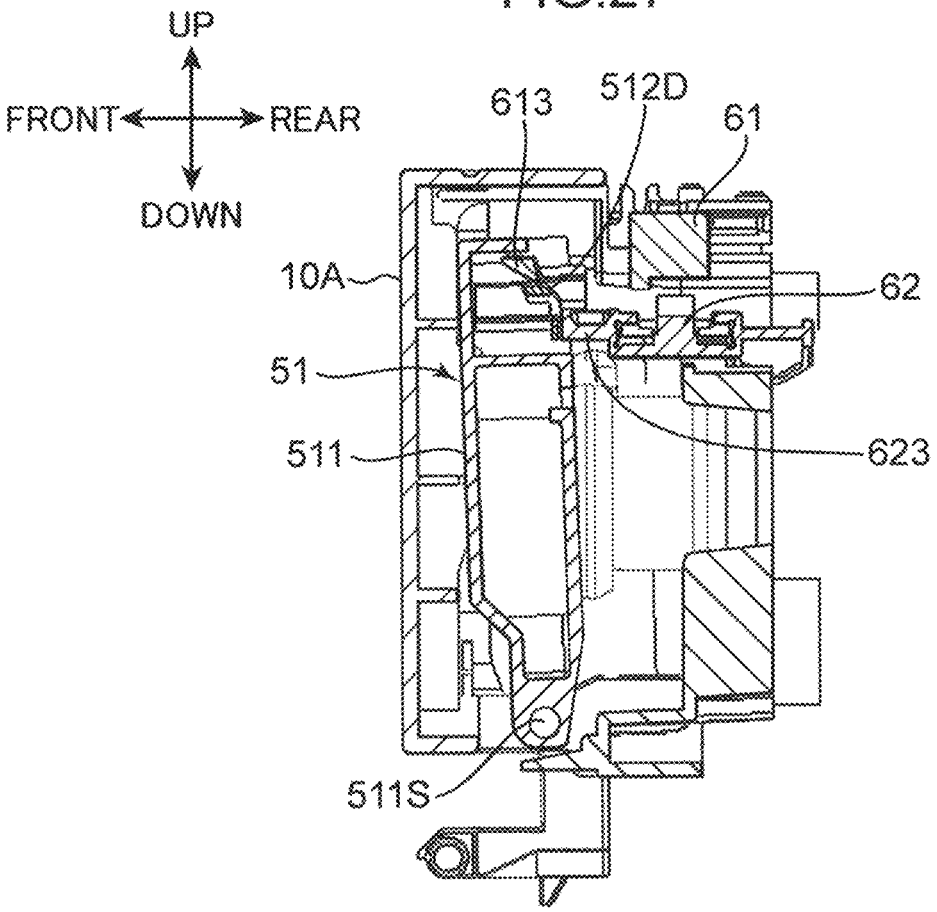
FIG. 27 is a side sectional view showing the lock restricting portion in the state where the toner container is attached to the apparatus body of the image forming apparatus according to the one embodiment of the present disclosure.

FIG. 23 is a perspective view showing the container cover 51 and the lock restricting portion 62 of the image forming apparatus 1 according to this embodiment. FIGS. 24A and 24B are front views showing the lock restricting portion 62 of the image forming apparatus 1. FIGS. 25A and 25B are a perspective view and an enlarged perspective view showing the lock restricting portion 62 in a state where the toner container 50 is attached to the apparatus body 10 of the image forming apparatus 1. FIGS. 26A and 26B are a perspective view and an enlarged perspective view showing the lock restricting portion 62 when the toner container 50 is not attached to the apparatus body 10 of the image forming apparatus 1. FIG. 27 is a side sectional view showing the lock restricting portion 62 in the state where the toner container 50 is attached to the apparatus body 10 of the image forming apparatus 1.

In this embodiment, if the toner container 50 is not attached to each of the yellow, magenta, cyan and black attaching portions 10Y, 10M, 10C and 10Bk of the apparatus body 10, the operation of the lock mechanism 51R corresponding to the attaching portion, to which the toner container 50 is not attached, is restricted. As an example, if the lock mechanism 51R locks the container cover 51 at a magenta position when the toner container 50 is not attached to the magenta attaching portion 10M, the user cannot attach the toner container 50 thereafter. Further, if the image forming apparatus 1 includes toner storages capable of storing toners between the toner containers 50 and the developing devices 23, an image forming operation in the image forming apparatus 1 can be allowed for a certain period of time even if the toner containers 50 are not attached. Thus, in this embodiment, an operation of locking the container covers 51 by the lock mechanisms 51R is restricted if the toner containers 50 are not attached to the apparatus body 10.

As shown in FIG. 23, the lock restricting portion 62 is slidably supported on the body lock portion 61 inside the container cover 51. Unless the toner container 50 is attached to the magenta attaching portion 10M, the third pressed portion 622 of the lock restricting portion 62 is arranged to enter a space to be occupied by the toner container 50 in the magenta attaching portion 10M. At this time, the restricting piece 623 of the lock restricting portion 62 is arranged at the interposed position to be interposed between the lever lock portion 512D and the engaging portion 613. FIG. 24A shows a state where the insertion of the rear end part of the toner container 50 into the magenta attaching portion 10M is started with the container cover 51 opened. If the toner container 50 is further inserted into the magenta attaching portion 10M, an outer peripheral part of the container body 500 of the toner container 50 comes into contact with the third pressed portion 622. As a result, the third pressed portion 622 is pushed up by the outer peripheral part of the container body 500, moves as indicated by an arrow of FIG. 24A and is arranged as shown in FIG. 24B. At this time, the restricting piece 623 of the lock restricting portion 62 is arranged at the separated position to be separated from the position between the lever lock portion 512D and the engaging portion 613.

With reference to FIGS. 25A and 25B, if the container cover 51 is rotated rearward about the cover supporting point portions 511S with the toner container 50 attached to the magenta attaching portion 10M, the lever lock portion 512D of the first lever 512 is engaged with the engaging portion 613 of the body lock portion 61. At this time, the restricting piece 623 of the lock restricting portion 62 is located to the right of the lever lock portion 512D and the engaging portion 613 and not interposed between the lever lock portion 512D and the engaging portion 613. Thus, the container cover 51 is locked by the lock mechanism 51R.

On the other hand, with reference to FIGS. 26A and 26B, if an attempt is made to rotate the container cover 51 rearward about the cover supporting point portions 511S and engage the lever lock portion 512D of the first lever 512 with the engaging portion 613 of the body lock portion 61 when the toner container 50 is not attached to the magenta attaching portion 10M, the lever lock portion 512D and the engaging portion 613 cannot be engaged with each other since the restricting piece 623 of the lock restricting portion 62 is interposed between the lever lock portion 512D and the engaging portion 613. Thus, the lock mechanism 51R cannot be set in the locking state. Note that, even in this case, the container cover 51 can be in contact with the front cover 10A while being slightly inclined with respect to the vertical direction, and the front cover 10A can be closed on the apparatus body 10.

As described above, in this embodiment, the restricting piece 623 is separated from the position between the lever lock portion 512D and the engaging portion 613 if the toner container 50 is attached to the apparatus body 10, whereby the state of the lock mechanism 51R is allowed to be changed from the unlocking state to the locking state. On the other hand, the restricting piece 623 is interposed between the lever lock portion 512D and the engaging portion 613 if the toner container 50 is not attached to the apparatus body 10, whereby a state change of the lock mechanism 51R from the unlocking state to the locking state is obstructed.

Thus, if the toner container 50 is not attached to the apparatus body 10, it is prevented that the container cover 51 is locked by the lock mechanism 51R and becomes difficult to open.

Particularly, by obstructing the engagement of the lever lock portion 512D and the engaging portion 613 by the restricting piece 623 being interposed between the lever lock portion 512D and the engaging portion 613, the container cover 51 is reliably prevented from being locked in the closed state.

Further, in this embodiment, the guide portions 611 are provided which guide the restricting piece 623 of the lock restricting portion 62 between the separated position and the interposed position. Thus, the restricting piece 623 can be stably guided to the separated position and the interposed position according to the mounted state of the toner container 50.

Furthermore, in this embodiment, the body lock portion 61 is mounted on the front frame 10F and integrally includes the engaging portion 613 and the guide portions 611. Thus, the restricting piece 623 of the lock restricting portion 62 can be stably positioned at the interposed position with respect to the engaging portion 613, and it can be stably obstructed that the container cover 51 is locked when the toner container 50 is not attached to the apparatus body 10.

Figure 28A:
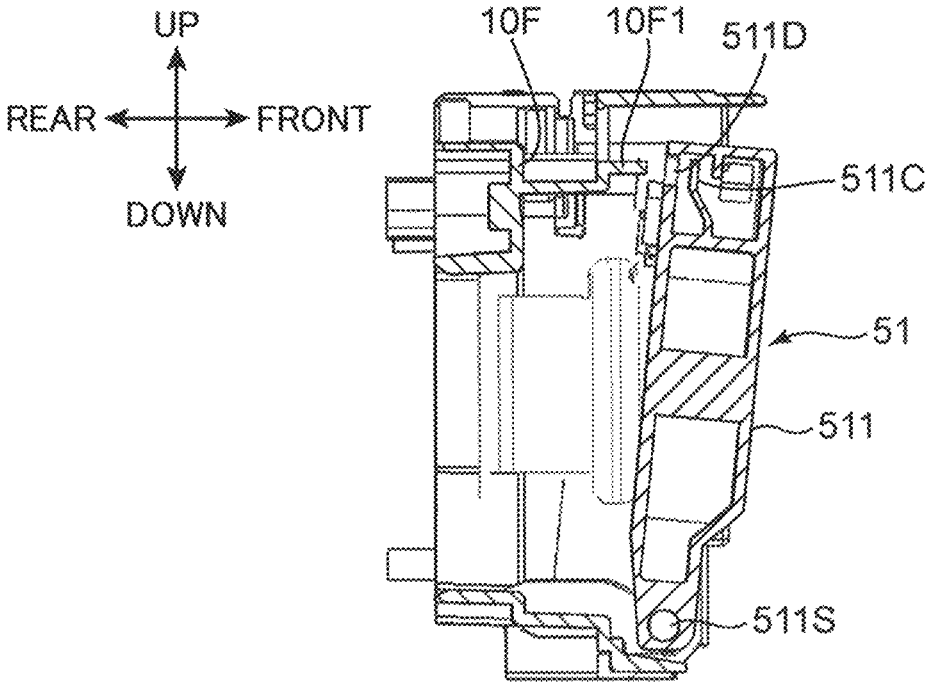
FIG. 28A is a side sectional view showing a state where the container cover is being closed on the apparatus body of the image forming apparatus according to the one embodiment of the present disclosure.
Figure 28B:
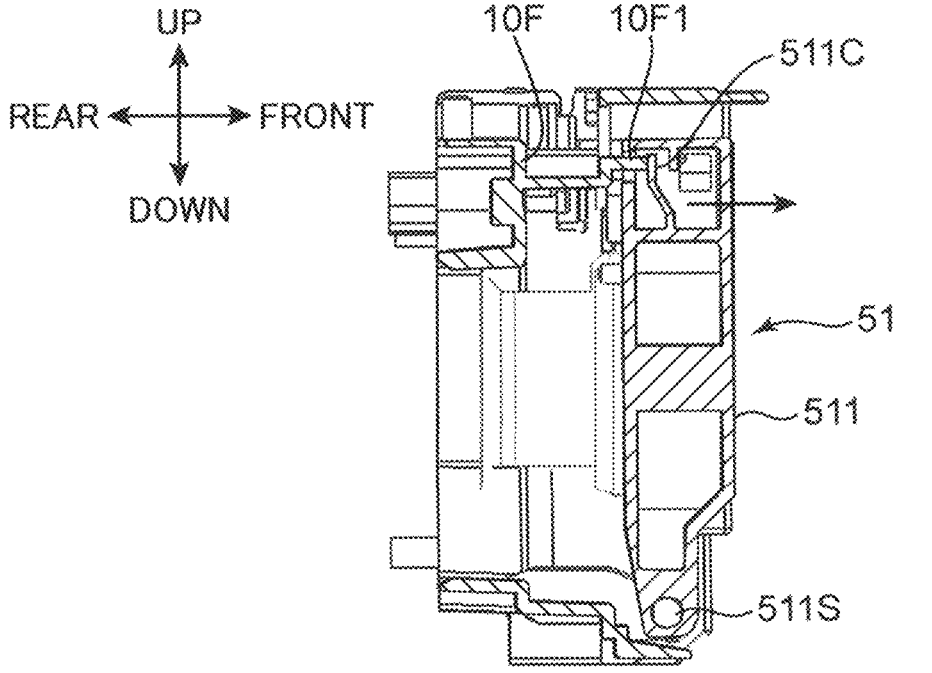
FIG. 28B is a side sectional view showing a state where the container cover is closed on the apparatus body of the image forming apparatus according to the one embodiment of the present disclosure.

FIGS. 28A and 28B are side sectional views showing a state where the container cover 51 is being closed on the apparatus body 10 of the image forming apparatus 1 according to this embodiment. In this embodiment, in closing the container cover 51, the frame projection 10F1 projecting on the front frame 10F enters the opening 511D of the container cover 51 and slightly presses an upper end part of the pressed piece 511C forward. Thus, the container cover 51 is locked by the lock mechanism 51R with the pressed piece 511C elastically deformed. As a result, if the locking of the container cover 51 by the lock mechanism 51R is released, an elastic force of the pressed piece 511C is released, whereby the container cover 51 can rotate forward as indicated by an arrow of FIG. 28B. Thus, the container cover 51 can be stably opened, along with the aforementioned arrangement of the center of gravity J of the container cover 51.

Figure 29:
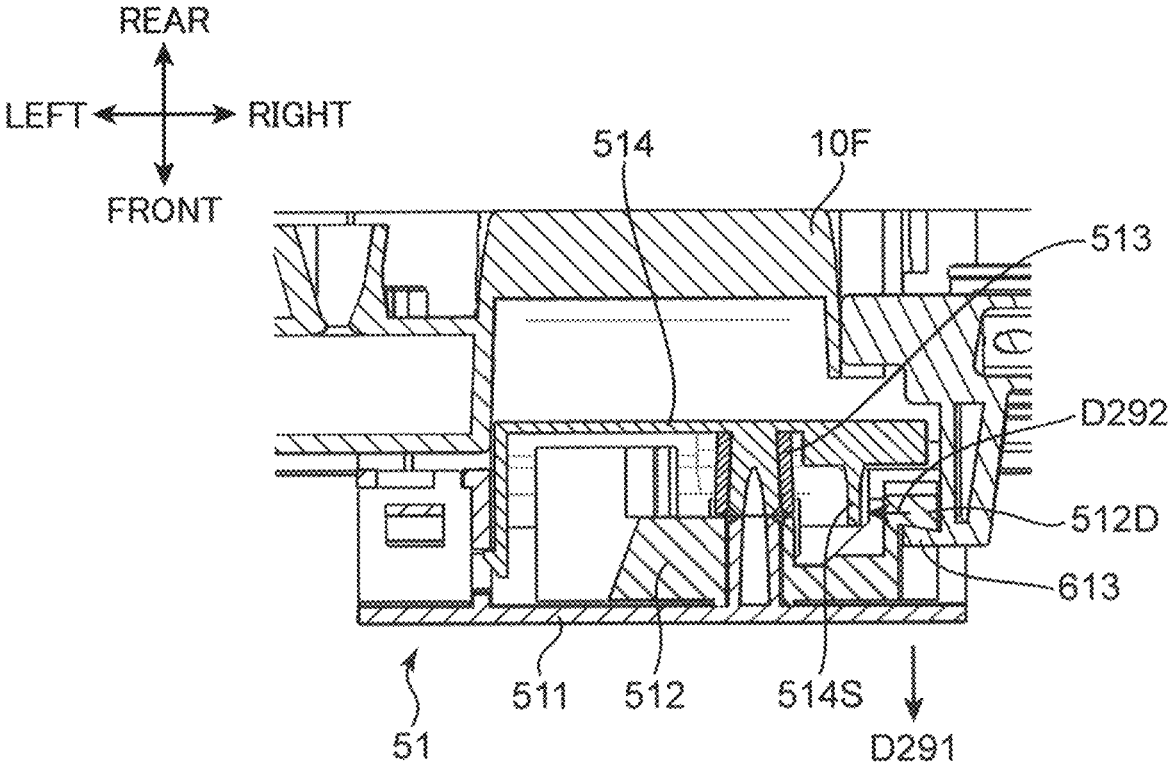
FIG. 29 is a horizontal sectional view showing the state where the container cover is closed on the apparatus body of the image forming apparatus according to the one embodiment of the present disclosure.

FIG. 29 is a horizontal sectional view showing a state where the container cover 51 is closed on the apparatus body 10 of the image forming apparatus 1 according to this embodiment. If the user is going to erroneously open the container cover 51 as indicated by an arrow D291 with the lever lock portion 512D and the engaging portion 613 engaged, there is a possibility that the lever lock portion 512D and the engaging portion 613 are disengaged. However, in this embodiment, an auxiliary cover rib 514S projecting forward from the auxiliary cover 514 of the container cover 51 is arranged to obstruct a leftward movement of the lever lock portion 512D. Thus, even if a forcible external force as described above is applied to the container cover 51, a large movement of the lever lock portion 512D in a direction of an arrow D292 is obstructed and the locked state of the container cover 51 can be stably maintained.

Note that each of the above functions and effects is not limited to the magenta attaching portion 10M, but is similarly achieved also in the yellow, magenta and black attaching portions 10Y, 10M and 10Bk.

The image forming apparatus 1 according to the one embodiment of the present disclosure has been described in detail above. According to this configuration, it is possible to provide the image forming apparatus 1 with the lock mechanism 51R capable of releasing the locked state while locking the container cover 51 in the closed state without including a dedicated drive source. Note that the present disclosure is not limited to this. For example, the present disclosure can be modified as follows.

(1) Although the image forming apparatus 1 includes the developing devices 23, the toner containers 50 and the container covers 51 of four colors in the above embodiment, the image forming apparatus 1 may include the developing device 23, the toner container 50 and the container cover 51 of one color to form a single-color image and the number of the respective devices may be other than 1 and 3.

(2) Although the projection 503 is arranged on the grip portion 502 of the toner container 50 in the above embodiment, the projection 503 may be arranged at another location of the toner container 50.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an apparatus body;

at least one image carrier to be rotated about a predetermined axis and having a circumferential surface for carrying a toner image;

at least one developing device for forming the toner image by supplying toner to the at least one image carrier;

a transfer unit for transferring the toner image carried on the at least one image carrier to a sheet;

at least one toner container including a container body for storing replenishing toner to be replenished to the at least one developing device, the toner container discharging the replenishing toner by the container body rotating in a first rotating direction about a predetermined rotation center axis while obstructing discharge of the replenishing toner by the container body rotating in a second rotating direction opposite to the first rotating direction about the rotation center axis;

a driver for generating a rotational drive force for selectively rotating the container body of the at least one toner container in the first rotating direction and the second rotating direction;

at least one container cover openably and closably supported on the apparatus body to face the at least one toner container, a state of the at least one container cover being changeable between an open state where the at least one toner container is allowed to be attached to and detached from the apparatus body and a closed state where the at least one toner container is obstructed from being attached to and detached from the apparatus body;

a lock mechanism capable of switching a state between a locking state for locking the at least one container cover in the closed state and an unlocking state for allowing the state of the at least one container cover to be changed between the closed state and the open state; and a lock restricting portion for allowing a state change of the lock mechanism from the unlocking state to the locking state if the at least one toner container is attached to the apparatus body and obstructing the state change of the lock mechanism from the unlocking state to the locking state if the at least one toner container is not attached to the apparatus body.

2. An image forming apparatus according to claim 1, wherein:

the lock mechanism maintains the locking state if the container body is rotated in the first rotating direction by the driver, and receives a rotational drive force of the driver to switch the state thereof from the locking state to the unlocking state if the container body is rotated in the second rotating direction by the driver.

3. An image forming apparatus according to claim 2, wherein:

the lock mechanism includes:

a container projection arranged on the at least one toner container to face the container cover and capable of rotating in each of the first and second rotating directions integrally with the container body;

an engaging portion arranged in the apparatus body to hold the container cover in the closed state;

a first lever supported on the container cover pivotably about a predetermined rotation center axis and including a lock portion to be disengaged from the engaging portion in the unlocking state while being engaged with the engaging portion in the locking state; and a second lever supported on the container cover pivotably about a predetermined rotation center axis and including a contact portion for coming into contact with the container projection, the second lever relatively pivots in a third rotating direction about the rotation center axis with respect to the first lever so that the lock portion of the first lever continues to be engaged with the engaging portion if the container body is rotated in the first rotating direction by the driver and the container projection comes into contact with the contact portion, whereby the lock mechanism maintains the locking state, the second lever pivots in a fourth rotating direction opposite to the third rotating direction about the rotation center axis integrally with the first lever if the container body is rotated in the second rotating direction by the driver and the container projection comes into contact with the contact portion, whereby the lock portion of the first lever is disengaged from the engaging portion and the state of the lock mechanism is switched from the locking state to the unlocking state, the lock restricting portion includes an interposing portion capable of being interposed between the lock portion of the first lever and the engaging portion, the interposing portion is separated from a position between the lock portion and the engaging portion if the at least one toner container is attached to the apparatus body, thereby allowing the state of the lock mechanism to be changed from the unlocking state to the locking state, and the interposing portion is interposed between the lock portion and the engaging portion if the at least one toner container is not attached to the apparatus body, thereby obstructing the state change of the lock mechanism from the unlocking state to the locking state.

4. An image forming apparatus according to claim 3, wherein:

the lock restricting portion includes a container contact portion capable of coming into contact with an outer peripheral part of the at least one toner container and is movable between a separated position where the interposing portion is arranged away from the position between the lock portion and the engaging portion and an interposed position where the interposing portion is interposed between the lock portion and the engaging portion, the image forming apparatus further comprising:

a guide portion for guiding the lock restricting portion to the separated position if the at least one toner container is attached to the apparatus body and the outer peripheral part of the toner container comes into contact with the container contact portion and guiding the lock restricting portion to the interposed position if the at least one toner container is not attached to the apparatus body.

5. An image forming apparatus according to claim 4, further comprising:

a body frame arranged on the apparatus body and formed with an opening for allowing the at least one toner container to be inserted thereinto; and a body lock portion mounted on the body frame and integrally including the engaging portion and the guide portion.

6. An image forming apparatus according to claim 3, wherein:

the rotation center axis of the first lever and the rotation center axis of the second lever are arranged on the same axis.

7. An image forming apparatus according to claim 3, wherein:

the second lever includes a pivoting/pressing portion for pressing the first lever so that the first lever pivots in the fourth rotating direction integrally with the second lever if the container body is rotated in the second rotating direction by the driver and the container projection comes into contact with the contact portion.

8. An image forming apparatus according to claim 3, wherein:

the state of the container cover is changeable between the open state and the closed state by rotating about a supporting point portion arranged on a lower end part of the container cover, a center of gravity of the container cover is arranged at a position more distant from the toner container than the supporting point portion in an attaching/detaching direction of the toner container, and the state of the container cover changes from the closed state to the open state by an own weight of the container cover if the lock mechanism is switched from the locking state to the unlocking state.

* * * * *